US008089437B2

(12) United States Patent
Maekawa

(10) Patent No.: US 8,089,437 B2
(45) Date of Patent: Jan. 3, 2012

(54) DRIVER CIRCUIT, ELECTRO-OPTICAL DEVICE, AND ELECTRONIC INSTRUMENT

(75) Inventor: Kazuhiro Maekawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1146 days.

(21) Appl. No.: 11/898,595

(22) Filed: Sep. 13, 2007

(65) Prior Publication Data

US 2008/0068316 A1 Mar. 20, 2008

(30) Foreign Application Priority Data

Sep. 20, 2006 (JP) ..... 2006-254161
Sep. 20, 2006 (JP) ..... 2006-254162

(51) Int. Cl.
*G09G 3/36* (2006.01)

(52) U.S. Cl. ..... 345/87; 345/96; 345/99; 345/212

(58) Field of Classification Search ..... 345/38, 345/50, 87–102
See application file for complete search history.

(56) References Cited

U.S. PATENT DOCUMENTS 7,084,852 B2 8/2006 Nishi et al.
2002/0109653 A1 8/2002 Kudo et al.
2006/0232542 A1 10/2006 Nishi et al.
2007/0013573 A1 * 1/2007 Hashimoto ..... 341/172
2008/0001941 A1 1/2008 Miura

FOREIGN PATENT DOCUMENTS

JP A 2002-244622 8/2002
JP A-2003-271105 9/2003
JP A-2007-47728 2/2007
JP A-2008-15038 1/2008

* cited by examiner

*Primary Examiner* — Kevin M Nguyen
*Assistant Examiner* — Kenneth B Lee, Jr.
(74) *Attorney, Agent, or Firm* — Oliff & Berridge, PLC

(57) ABSTRACT

A driver circuit which drives a source line of an electro-optical device includes a source line driver section which supplies a grayscale voltage corresponding to grayscale data to the source line, a source output switch section which short-circuits the source line and a common line connected with a capacitor before the source line driver section drives the source line, and a charge recycle control section which controls the source output switch section. The charge recycle control section determines whether or not to short-circuit the source line and the common line in source line units based on the grayscale data and polarity of a common electrode voltage supplied to a common electrode opposite to a pixel electrode of the electro-optical device. The source output switch section short-circuits the source line and the common line based on the determination result of the charge recycle control section.

23 Claims, 28 Drawing Sheets

| COMMON ELECTRODE VOLTAGE IN PRECEDING LINE | COMMON ELECTRODE VOLTAGE IN PRESENT LINE | GRAYSCALE DATA IN PRESENT LINE | CHARGE RECYCLE (NORMALLY WHITE) | CHARGE RECYCLE (NORMALLY BLACK) |
|---|---|---|---|---|
| VCOML | VCOMH | MSB=1 | enable | disable |
| | | MSB=0 | disable | enable |
| VCOMH | VCOML | MSB=1 | disable | enable |
| | | MSB=0 | enable | disable |

| GRAYSCALE DATA IN PRECEDING LINE | GRAYSCALE DATA IN PRESENT LINE | CHARGE RECYCLE |
|---|---|---|
| MSB=0 | MSB=0 | disable |
| MSB=0 | MSB=1 | enable |
| MSB=1 | MSB=0 | enable |
| MSB=1 | MSB=1 | disable |

DRIVER CIRCUIT, ELECTRO-OPTICAL DEVICE, AND ELECTRONIC INSTRUMENT

Japanese Patent Application No. 2006-254161 filed on Sep. 20, 2006 and Japanese Patent Application No. 2006-254162 filed on Sep. 20, 2006, are hereby incorporated by reference in their entirety.

BACKGROUND OF THE INVENTION

The present invention relates to a driver circuit, an electro-optical device, and an electronic instrument.

As a liquid crystal display (LCD) panel (display panel in a broad sense; electro-optical device in a broader sense) used for electronic instruments such as portable telephones, a simple matrix type LCD panel and an active matrix type LCD panel using a switching element such as a thin film transistor (hereinafter abbreviated as "TFT") have been known.

The simple matrix method can easily reduce power consumption as compared with the active matrix method. On the other hand, it is difficult to increase the number of colors or display a video image using the simple matrix method. The active matrix method is suitable for increasing the number of colors or displaying a video image, but has difficulty in reducing power consumption.

The simple matrix type LCD panel and the active matrix type LCD panel are driven so that the polarity of the voltage applied to a liquid crystal (electro-optical material in a broad sense) forming a pixel is alternately reversed. As such an alternating drive method, a line inversion drive method and a field inversion drive (frame inversion drive) method are known. In the line inversion drive method, the polarity of the voltage applied to the liquid crystal is reversed in units of one or more scan lines. In the field inversion drive method, the polarity of the voltage applied to the liquid crystal is reversed in field (frame) units.

In this case, the voltage level applied to a pixel electrode forming a pixel can be reduced by changing a common electrode voltage (common voltage) supplied to a common electrode opposite to the pixel electrode at the inversion drive timing.

However, power consumption is increased accompanying charging/discharging the liquid crystal even when using such an alternating drive method. In order to solve this problem, JP-A-2002-244622 discloses technology of reducing power consumption by initializing charges stored in the liquid crystal to zero by short-circuiting two electrodes provided on either side of the liquid crystal during inversion drive, thereby causing the drive voltage to transition to the intermediate voltage before short-circuiting the electrodes, for example.

However, the technology disclosed in JP-A-2002-244622 has a problem in which the effect of reducing power consumption varies depending on the voltage applied to the source line. Therefore, the effect of reducing the amount of charges by charging/discharging the common electrode of which the polarity of the voltage is reversed is insufficient. According to the above technology, the amount of charging/discharging may be increased by short-circuiting the electrodes provided on either side of the liquid crystal depending on the relationship between the voltage applied to the source line and the polarity of the common electrode voltage, whereby the effect of reducing power consumption may be reduced.

SUMMARY

According to one aspect of the invention, there is provided a driver circuit which drives a source line of an electro-optical device based on grayscale data, the driver circuit comprising:

a source line driver section which supplies a grayscale voltage corresponding to the grayscale data to the source line;

a source output switch section which short-circuits the source line and a common line connected with a capacitor before the source line driver section drives the source line; and a charge recycle control section which controls the source output switch section;

the charge recycle control section determining whether or not to short-circuit the source line and the common line in source output units based on the grayscale data and polarity of a common electrode voltage supplied to a common electrode opposite to a pixel electrode of the electro-optical device; and the source output switch section short-circuiting the source line and the common line based on the determination result of the charge recycle control section.

According to another aspect of the invention, there is provided a driver circuit which drives a source line of an electro-optical device based on grayscale data, the driver circuit comprising:

a source line driver section which supplies a grayscale voltage corresponding to the grayscale data to the source line;

a source output switch section which short-circuits the source line and a common line connected with a capacitor before the source line driver section drives the source line; and a charge recycle control section which controls the source output switch section;

the charge recycle control section determining whether or not to short-circuit the source line and the common line in source output units based on a first grayscale voltage supplied to the source line in a preceding horizontal scan period and a second grayscale voltage supplied to the source line in a present horizontal scan period; and the source output switch section short-circuiting the source line and the common line based on the determination result of the charge recycle control section.

According to a further aspect of the invention, there is provided an electro-optical device comprising:

source lines;

gate lines;

pixel electrodes, each of the pixel electrodes being specified by the gate line and the source line;

a common electrode opposite to the pixel electrodes; and one of the above driver circuits which drives the source lines.

According to a still another aspect of the invention, there is provided an electro-optical device comprising one of the above driver circuits.

According to a still further aspect of the invention, there is provided an electronic instrument comprising one of the above driver circuits.

According to a yet another aspect of the invention, there is provided an electronic instrument comprising the above electro-optical device.

DETAILED DESCRIPTION OF THE EMBODIMENT

Figure 1:
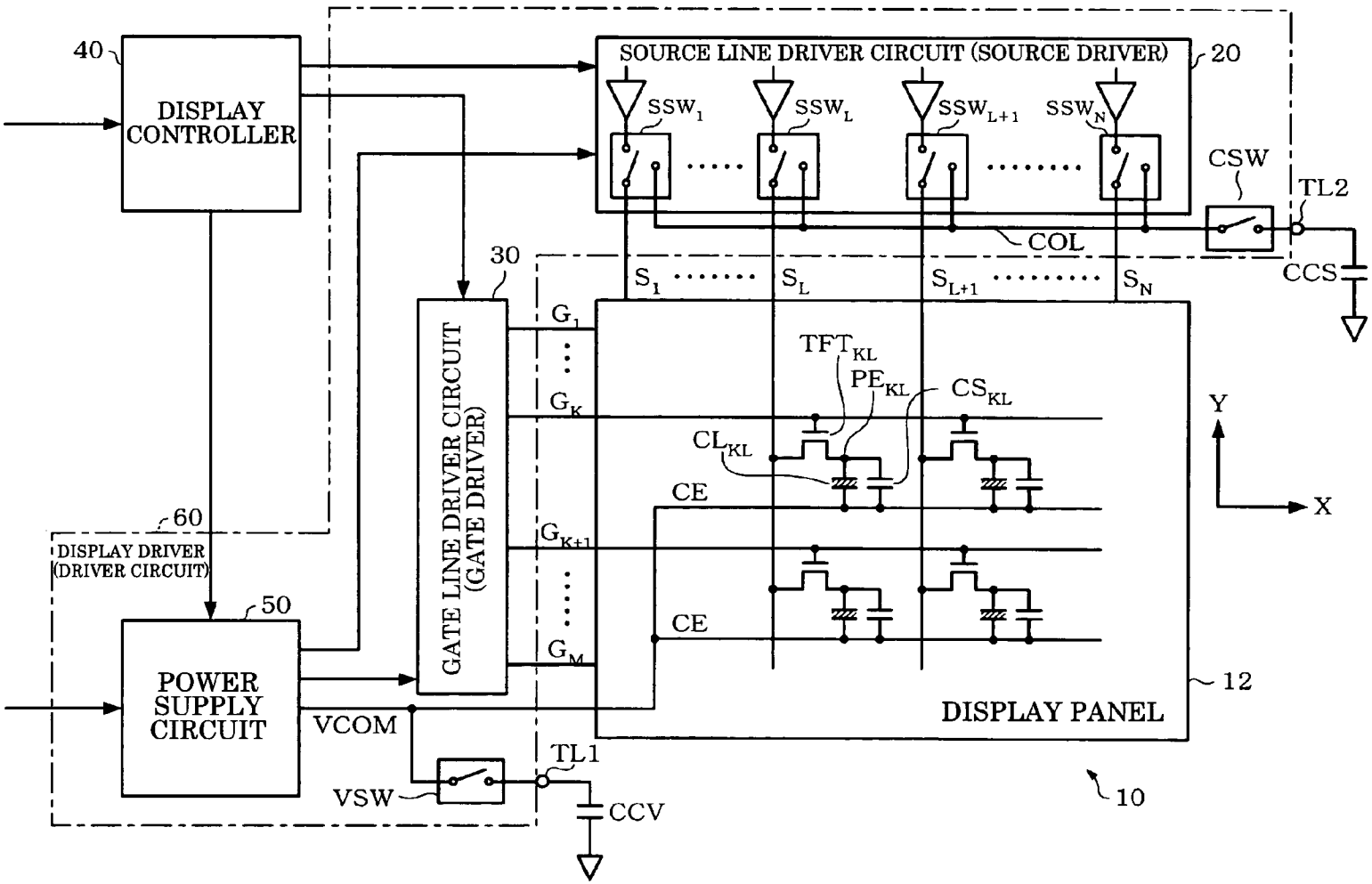
FIG. 1 shows an example of a block diagram of a liquid crystal device according to one embodiment of the invention.

Aspects of the invention may provide a driver circuit, an electro-optical device, and an electronic instrument capable of reducing power consumption by recycling charges without unnecessarily consuming power.

According to one embodiment of the invention, there is provided a driver circuit which drives a source line of an electro-optical device based on grayscale data, the driver circuit comprising:

a source line driver section which supplies a grayscale voltage corresponding to the grayscale data to the source line;

a source output switch section which short-circuits the source line and a common line connected with a capacitor before the source line driver section drives the source line; and a charge recycle control section which controls the source output switch section;

the charge recycle control section determining whether or not to short-circuit the source line and the common line in source output units based on the grayscale data and polarity of a common electrode voltage supplied to a common electrode opposite to a pixel electrode of the electro-optical device; and the source output switch section short-circuiting the source line and the common line based on the determination result of the charge recycle control section.

According to this embodiment, charges of the source line can be recycled before the driver circuit drives the source line. The charges are recycled by short-circuiting the source line and the common line connected with the capacitor at one end. The potential of the drive target source line can be set at a given level without externally charging/discharging the source line by recycling the charges of the source line. Power is not consumed when recycling charges in this manner. Therefore, since it suffices that the driver circuit drive the source line so that the potential of the source line changes from the given level to the level of the grayscale voltage corresponding to the grayscale data due to charge recycle, power consumption accompanying driving the source line is generally reduced.

In order to reduce the power consumption of an electro-optical device, the polarity of the common electrode voltage applied to the common electrode and the polarity of the source voltage applied to the source line are reversed. In line inversion drive, the common electrode voltage changes in line units, and the change in the voltage level of the common electrode changes the voltage level of the source line by capacitive coupling of the common electrode and the source line (or pixel electrode), for example. If charges are recycled as described above after the voltage level of the source line has changed, unnecessary charging/discharging may be required.

According to this embodiment, the charge recycle control section determines whether or not to short-circuit the source line and the common line in source output units based on the grayscale data and polarity of the common electrode voltage supplied to the common electrode opposite to the pixel electrode of the electro-optical device, and the source output switch section short-circuits the source line and the common line based on the determination result. Therefore, charges are not recycled when unnecessary charging/discharging is required. As a result, a driver circuit can be provided which is capable of reducing power consumption by recycling charges without unnecessarily consuming power.

In the driver circuit, when a high-potential-side voltage and a low-potential-side voltage are alternately supplied as the common electrode voltage, the charge recycle control section may determine whether or not a grayscale voltage supplied to the source line in a present horizontal scan period is higher in potential than a given reference voltage when the common electrode voltage changes, and the source output switch section may short-circuit the source line and the common line when the charge recycle control section has determined that the grayscale voltage supplied to the source line in the present horizontal scan period is lower in potential than the reference voltage when the common electrode voltage changes from the low-potential-side voltage to the high-potential-side voltage, or determined that the grayscale voltage is higher in potential than the reference voltage when the common electrode voltage changes from the high-potential-side voltage to the low-potential-side voltage.

According to this embodiment, the charge recycle control section determines whether or not the grayscale voltage supplied to the source line in the present horizontal scan period is lower in potential than the given reference voltage when the common electrode voltage changes from the low-potential-side voltage to the high-potential-side voltage, or determines whether or not the grayscale voltage is higher in potential than the reference voltage when the common electrode voltage changes from the high-potential-side voltage to the low-potential-side voltage. In the above case, since the amount of charging/discharging can be reduced by recycling charges when the common electrode voltage has changed, a driver circuit can be provided which is capable of reducing power consumption by recycling charges without unnecessarily consuming power.

In the driver circuit, when the charge recycle control section has determined that, based on data of the most significant bit of the grayscale data for generating the grayscale voltage supplied to the source line in the present horizontal scan period, the data of the most significant bit is first data when the common electrode voltage changes from the low-potential-side voltage to the high-potential-side voltage or the data of the most significant bit is second data obtained by reversing the first data when the common electrode voltage changes from the high-potential-side voltage to the low-potential-side voltage, the source output switch section may short-circuit the source line and the common line.

In the driver circuit, the reference voltage may be a grayscale voltage corresponding to an intermediate grayscale value.

According to the above configuration, since the grayscale voltage corresponding to the intermediate grayscale value is used as the reference voltage, a driver circuit can be provided which has a simple configuration and is capable of reducing power consumption by recycling charges without unnecessarily consuming power. Moreover, since the above determination can be made using only the data of the most significant bit of the grayscale data, the configuration of the driver circuit can be further simplified.

In the driver circuit, the high-potential-side voltage or the low-potential-side voltage may be supplied to the common electrode by line inversion drive.

In the driver circuit, when supplying the high-potential-side voltage or the low-potential-side voltage to the common electrode by frame inversion drive, the charge recycle control section may determine whether or not to short-circuit the source line and the common line in source output units based on a first grayscale voltage supplied to the source line in a preceding horizontal scan period and a second grayscale voltage supplied to the source line in the present horizontal scan period, and the source output switch section may short-circuit the source line and the common line based on the determination result of the charge recycle control section.

According to another embodiment of the invention, there is provided a driver circuit which drives a source line of an electro-optical device based on grayscale data, the driver circuit comprising:

a source line driver section which supplies a grayscale voltage corresponding to the grayscale data to the source line;

a source output switch section which short-circuits the source line and a common line connected with a capacitor before the source line driver section drives the source line; and a charge recycle control section which controls the source output switch section;

the charge recycle control section determining whether or not to short-circuit the source line and the common line in source output units based on a first grayscale voltage supplied to the source line in a preceding horizontal scan period and a second grayscale voltage supplied to the source line in a present horizontal scan period; and the source output switch section short-circuiting the source line and the common line based on the determination result of the charge recycle control section.

According to this embodiment, charges stored in the source line can be recycled before the driver circuit drives the source line. The charges are recycled by short-circuiting the source line and the common line connected with the capacitor at one end. The potential of the drive target source line can be set at a given level without externally charging/discharging the source line by recycling the charges stored in the source line. Power is not consumed when recycling charges in this manner. Therefore, since it suffices that the driver circuit drive the source line so that the potential of the source line changes from the given level to the level of the grayscale voltage corresponding to the grayscale data due to charge recycle, power consumption accompanying driving the source line is generally reduced. On the other hand, unnecessary charging/discharging may be required by recycling charges depending on the level of the grayscale voltage set for the source line in the horizontal scan period immediately before the present horizontal scan period.

According to this embodiment, the charge recycle control section determines whether or not to short-circuit the source line and the common line in source output units based on the first grayscale voltage supplied to the source line in the preceding horizontal scan period and the second grayscale voltage supplied to the source line in the present horizontal scan period, and the source output switch section short-circuits the source line and the common line based on the determination result. Therefore, charges are not recycled when unnecessary charging/discharging is required. As a result, a driver circuit can be provided which is capable of reducing power consumption by recycling charges without unnecessarily consuming power.

In the driver circuit, the charge recycle control section may determine whether or not the first and second grayscale voltages are higher or lower in potential than a given reference voltage in source output units; and the source output switch section may short-circuit the source line and the common line when the charge recycle control section has determined that the first and second grayscale voltages are higher or lower in potential than the reference voltage.

According to this embodiment, the charge recycle control section determines whether or not the first and second grayscale voltages are higher or lower in potential than the given reference voltage. When one of the first and second grayscale voltages is higher in potential than the reference voltage and the other is lower in potential than the reference voltage, the potential of the source line is set at the given level when recycling charges before the driver circuit drives the source line, whereby unnecessary charging/discharging is required. According to this embodiment, since the source line and the common line are short-circuited on condition that the above determination has been made in source output units, a driver circuit can be provided which is capable of reducing power consumption by recycling charges without unnecessarily consuming power.

In the driver circuit, the charge recycle control section may compare data of the most significant bit of first grayscale data for generating the first grayscale voltage with data of the most significant bit of second grayscale data for generating the second grayscale voltage, and may determine whether or not to short-circuit the source line and the common line based on the comparison result.

In the driver circuit, the reference voltage may be a grayscale voltage corresponding to an intermediate grayscale value.

According to the above configuration, since the grayscale voltage corresponding to the intermediate grayscale value is used as the reference voltage, a driver circuit can be provided which has a simple configuration and is capable of reducing power consumption by recycling charges without unnecessarily consuming power. Moreover, since the above determination can be made using only the data of the most significant bit of the grayscale data, the configuration of the driver circuit can be further simplified.

In the driver circuit, the charge recycle control section may determine whether or not to short-circuit the source line and the common line based on a first comparison result obtained by comparing first grayscale data for generating the first grayscale voltage with given reference data and a second comparison result obtained by comparing second grayscale data for generating the second grayscale voltage with the reference data.

In the driver circuit, the charge recycle control section may determine whether or not both of the first and second grayscale data is higher or lower than the reference data in source output units; and the source output switch section may short-circuit the source line and the common line when the charge recycle control section has determined that both of the first and second grayscale data is higher or lower than the reference data.

According to the above configuration, whether the grayscale voltages in two consecutive horizontal scan periods are higher or lower in potential than the voltage which can be set between the highest voltage $V_H$ and the lowest voltage $V_L$ can be determined, whereby charges can be recycled or charge recycle can be omitted. Therefore, even if the grayscale characteristics of the electro-optical device indicating the relationship between the grayscale data and the grayscale voltage (horizontal axis: grayscale data, vertical axis: grayscale voltage) do not have a linear relationship, the criterion for determining whether or not to recycle charges can be changed, whereby the driver circuit can be applied to a driver circuit which drives various electro-optical devices. Specifically, a driver circuit can be provided which is capable of reducing power consumption by recycling charges without unnecessarily consuming power, even when driving various electro-optical devices.

The driver circuit may comprise:

a first source short circuit switch provided between the common line and a first source output node to which a voltage output to a first source line of the electro-optical device is supplied; and a source charge storage switch provided between the common line and a second capacitor element connection node connected with one end of a second capacitor element;

wherein the first source output node and the second capacitor element connection node may be electrically connected through the first source short circuit switch and the source charge storage switch, and the first source line may be driven by supplying a voltage corresponding to the grayscale data to the first source output node in a state in which the first source output node and the second capacitor element connection node are electrically disconnected by the first source short circuit switch and the source charge storage switch.

According to this embodiment, the first source output node and the second capacitor element connection node are electrically connected through the first source short circuit switch and the source charge storage switch, and the voltage corresponding to the grayscale data is then supplied to the first source output node. In this case, one end of the second capacitor element and the first source output node are set at the same potential, whereby one end of the second capacitor element is charged with charges stored in the first source output node or the parasitic capacitor of the source line connected with the first source output node, or the parasitic capacitor of the first source output node is charged with charges stored in the second capacitor element. Therefore, the potential of the first source output node or the like can be changed without supplying charges from an external power supply. Accordingly, it suffices to supply charges to the first source output node based on the potential which has changed as described above, whereby power consumption can be reduced.

The driver circuit may comprise:

a common electrode charge storage switch provided between a first capacitor element connection node connected with one end of a first capacitor element and a common electrode voltage output node to which voltage of the common electrode opposite to the pixel electrode of the electro-optical device through an electro-optical material is supplied;

wherein the common electrode voltage output node and the first capacitor element connection node may be electrically connected through the common electrode charge storage switch, and the common electrode may then be driven by supplying the common electrode voltage to the common electrode voltage output node.

According to this embodiment, the common electrode voltage output node and the first capacitor element connection node are electrically connected through the common electrode charge storage switch, and the common electrode voltage is then supplied to the common electrode voltage output node. In this case, one end of the first capacitor element and the common electrode are set at the same potential, whereby charges stored in the parasitic capacitor of the common electrode are supplied to one end of the first capacitor element, or charges stored in the first capacitor element are supplied to the parasitic capacitor of the common electrode. Therefore, the potential of the common electrode can be changed without supplying charges from an external power supply. Accordingly, it suffices to supply charges to the common electrode based on the potential which has changed as described above, whereby power consumption can be reduced. Moreover, since the common electrode is set at the high-potential-side voltage or the low-potential-side voltage, power consumption can be reliably reduced using a simple configuration independent of the grayscale data, whereby the effect of reducing power consumption by charge recycle is remarkably increased.

According to another embodiment of the invention, there is provided an electro-optical device comprising:

source lines;

gate lines;

pixel electrodes, each of the pixel electrodes being specified by the gate line and the source line;

a common electrode opposite to the pixel electrodes; and one of the above driver circuits which drives the source lines.

According to another embodiment of the invention, there is provided an electro-optical device comprising one of the above driver circuits.

According to the above configuration, an electro-optical device can be provided which is capable of reducing power consumption by recycling charges without unnecessarily consuming power.

According to another embodiment of the invention, there is provided an electronic instrument comprising one of the above driver circuits.

According to another embodiment of the invention, there is provided an electronic instrument comprising the above electro-optical device.

According to the above configuration, an electronic instrument can be provided which is capable of reducing power consumption by recycling charges without unnecessarily consuming power.

Embodiments of the invention are described below in detail with reference to the drawings. Note that the embodiments described below do not in any way limit the scope of the invention laid out in the claims. Note that all elements of the embodiments described below should not necessarily be taken as essential requirements for the invention.

1. Liquid Crystal Device

FIG. 1 shows an example of a block diagram of a liquid crystal device according to this embodiment.

A liquid crystal device 10 (liquid crystal display device; display device in a broad sense) includes a display panel 12 (liquid crystal display (LCD) panel in a narrow sense), a source line driver circuit 20 (source driver in a narrow sense), a gate line driver circuit 30 (gate driver in a narrow sense), a display controller 40, and a power supply circuit 50. The liquid crystal device 10 need not necessarily include all of these circuit blocks. The liquid crystal device 10 may have a configuration in which some of the circuit blocks are omitted.

The display panel 12 (electro-optical device in a broad sense) includes gate lines (scan lines), source lines (data lines), and pixel electrodes, each of the pixel electrodes being specified by the gate line and the source line. In this case, an active matrix type liquid crystal device may be formed by connecting a thin film transistor (TFT; switching element in a broad sense) with the source line and connecting the pixel electrode with the TFT.

Specifically, the display panel 12 is formed on an active matrix substrate (e.g. glass substrate). Gate lines $G_1$ to $G_M$ (M is a positive integer equal to or larger than two), arranged in a direction Y in FIG. 1 and extending in a direction X, and source lines $S_1$, to $S_N$ (N is a positive integer equal to or larger than two), arranged in the direction X and extending in the direction Y, are disposed on the active matrix substrate. A thin film transistor $TFT_{KL}$ (switching element in a broad sense) is provided at a position corresponding to the intersection of the gate line $G_K$ ($1 \leqq K \leqq M$, K is a positive integer) and the source line $S_L$ ($1 \leqq L \leqq N$, L is a positive integer).

A gate electrode of the thin film transistor $TFT_{KL}$ is connected with the gate line $G_K$, a source electrode of the thin film transistor $TFT_{KL}$ is connected with the source line $S_L$, and a drain electrode of the thin film transistor $TFT_{KL}$ is connected with a pixel electrode $PE_{KL}$. A liquid crystal capacitor $CL_{KL}$ (liquid crystal element) and a storage capacitor $CS_{KL}$ are formed between the pixel electrode $PE_{KL}$ and a common electrode CE opposite to the pixel electrode $PE_{KL}$ through a liquid crystal (electro-optical material in a broad sense). The liquid crystal is sealed between the active matrix substrate provided with the thin film transistor $TFT_{KL}$, the pixel electrode $PE_{KL}$, and the like and a common substrate provided with the common electrode CE. The transmissivity of the pixel changes depending on the voltage applied between the pixel electrode $PE_{KL}$ and the common electrode CE.

The voltage level of a common electrode voltage VCOM (high-potential-side voltage VCOMH and low-potential-side voltage VCOML) applied to the common electrode CE is generated by a common electrode voltage generation circuit included in the power supply circuit 50. The common electrode CE may be formed in a striped pattern corresponding to each gate line instead of forming the common electrode CE over the entire common substrate.

The source line driver circuit 20 drives the source lines $S_1$, to $S_N$ of the display panel 12 based on grayscale data. The gate line driver circuit 30 scans (sequentially drives) the gate lines $G_1$ to $G_M$ of the display panel 12.

The display controller 40 controls the source line driver circuit 20, the gate line driver circuit 30, and the power supply circuit 50 according to information set by a host (not shown) such as a central processing unit (CPU). Specifically, the display controller 40 sets the operation mode of the source line driver circuit 20 and the gate line driver circuit 30 or supplies a vertical synchronization signal or a horizontal synchronization signal generated therein to the source line driver circuit 20 and the gate line driver circuit 30, and controls the power supply circuit 50 regarding the polarity inversion timing of the voltage level of the common electrode voltage VCOM applied to the common electrode CE, for example.

The power supply circuit 50 generates various voltage levels (grayscale voltages) necessary for driving the display panel 12 and the voltage level of the common electrode voltage VCOM applied to the common electrode CE based on a voltage supplied from the outside.

In the liquid crystal device 10 having such a configuration, the source line driver circuit 20, the gate line driver circuit 30, and the power supply circuit 50 cooperate to drive the display panel 12 based on grayscale data supplied from the outside under control of the display controller 40.

In FIG. 1, a display driver 60 (driver circuit in a broad sense) may be formed as a semiconductor device (integrated circuit (IC)) by integrating the source line driver circuit 20, the gate line driver circuit 30, and the power supply circuit 50.

The display driver 60 shown in FIG. 1 may have a configuration in which the gate line driver circuit 30 is omitted. In FIG. 1, it suffices that the display driver 60 according to this embodiment include the source line driver circuit 20 and the common electrode voltage generation circuit of the power supply circuit 50.

The display driver 60 further includes source output switch circuits (source output switch sections) $SSW_1$ to $SSW_N$, each of the source output switch circuits being provided between the source line and an output buffer which drives the source line. The output of the output buffer is connected with a first terminal of the source output switch circuit. The source line is connected with a second terminal of the source output switch circuit. One end of a common line COL is connected with a third terminal of the source output switch circuit. The source output switch circuits $SSW_1$ to $SSW_N$ are independently ON/OFF-controlled using a control signal (not shown). Specifically, the source output switch circuits are ON/OFF-controlled in source output units.

The display driver 60 includes a source charge storage second capacitor element connection terminal TL2 and a source charge storage switch CSW. The source charge storage switch CSW is provided between the other end of the common line COL and the second capacitor element connection terminal TL2. When the source charge storage switch CSW is set in a conducting state, each of the source output switch circuits $SSW_1$ to $SSW_N$ can electrically connect the source line with the common line COL.

In other words, the common line COL includes a second capacitor element connection node. One end of a second capacitor element CCS is electrically connected with the second capacitor element connection terminal TL2. A specific power supply voltage (e.g. system ground power supply voltage VSS) is supplied to the other end of the second capacitor element CCS. In FIG. 1, the second capacitor element CCS is provided outside the display driver 60. Note that the second capacitor element CCS may be provided in the display driver 60.

The display driver 60 may further include a first capacitor element connection terminal TL1 and a common electrode charge storage switch VSW. The common electrode charge storage switch VSW is provided between the output of the common electrode voltage generation circuit of the power supply circuit 50 (common electrode voltage output node to which the common electrode voltage VCOM is supplied) and the first capacitor element connection terminal TL1. One end of a first capacitor element CCV is electrically connected with the first capacitor element connection terminal TL1. A specific power supply voltage (e.g. system ground power supply voltage VSS) is supplied to the other end of the first capacitor element CCV. In FIG. 1, the first capacitor element CCV is provided outside the display driver 60. Note that the first capacitor element CCV may be provided in the display driver 60.

When the common electrode charge storage switch VSW is set in a conducting state, the output of the common electrode voltage generation circuit of the power supply circuit 50 is set in a high impedance state.

In FIG. 1, the liquid crystal device 10 includes the display controller 40. Note that the display controller 40 may be provided outside the liquid crystal device 10. Alternatively, the host may be provided in the liquid crystal device 10 together with the display controller 40. Some or all of the source line driver circuit 20, the gate line driver circuit 30, the display controller 40, and the power supply circuit 50 may be formed on the display panel 12.

Figure 2:
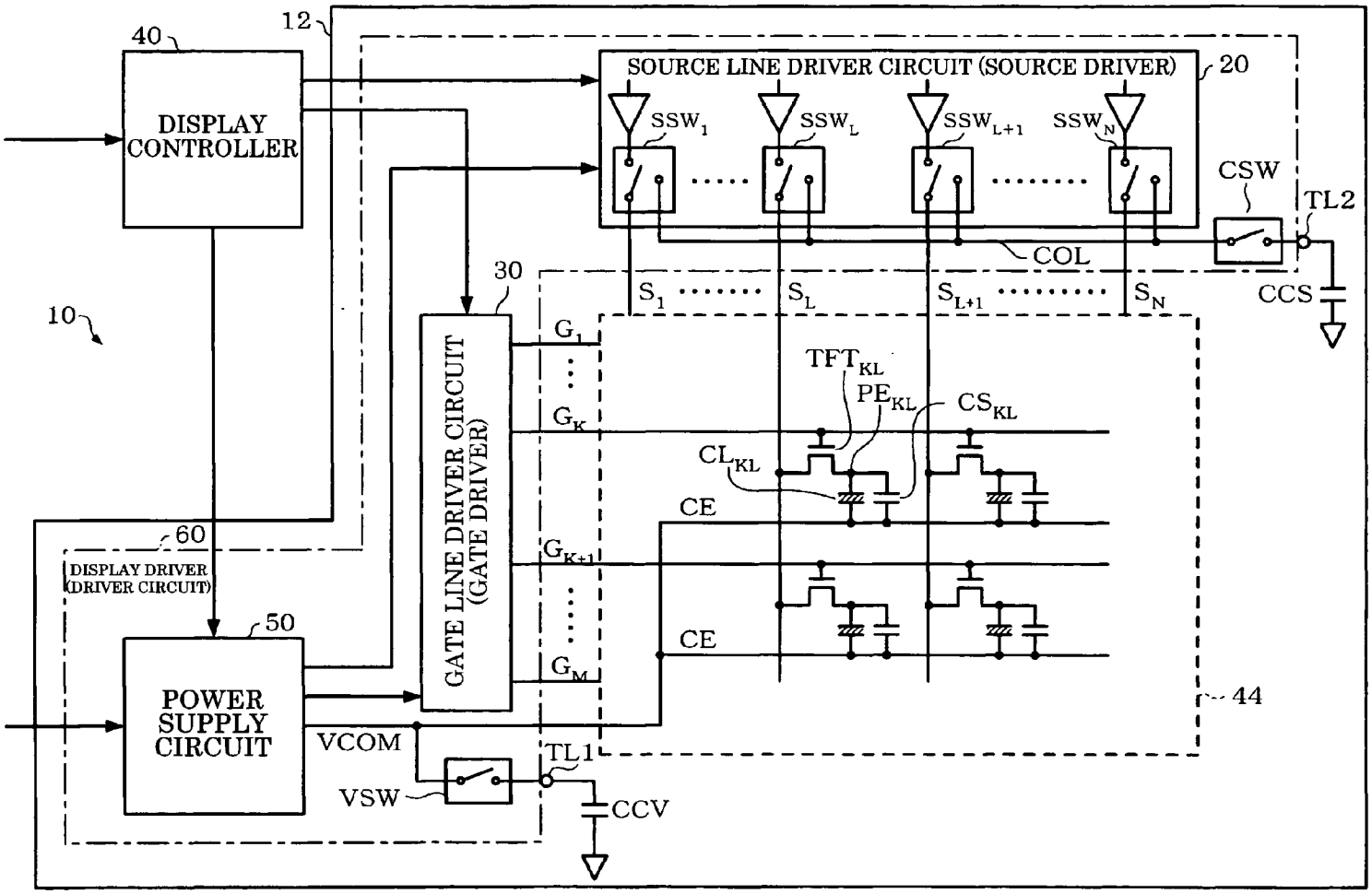
FIG. 2 is a block diagram showing another configuration example of a liquid crystal device according to one embodiment of the invention.

FIG. 2 is a block diagram showing another configuration example of the liquid crystal device according to this embodiment.

In FIG. 2, the display driver 60 including the source line driver circuit 20, the gate line driver circuit 30, and the power supply circuit 50 is formed on the display panel 12 (panel substrate). Specifically, the display panel 12 may be configured to include gate lines, source lines, pixels (pixel electrodes), each of the pixels being specified by the gate line and the source line, a source line driver circuit which drives the source lines, and a gate line driver circuit which scans the gate lines. The pixels are formed in a pixel formation region 44 of the display panel 12. Each pixel may include a TFT of which the source is connected with the source line and the gate is connected with the gate line, and a pixel electrode connected with the drain of the TFT.

In FIG. 2, at least one of the gate line driver circuit 30 and the power supply circuit 50 may not be provided on the display panel 12.

In FIG. 1 or 2, the display driver 60 may include the display controller 40. In FIG. 1 or 2, the display driver 60 may be a semiconductor device in which either the source line driver circuit 20 or the gate line driver circuit 30 and the power supply circuit 50 are integrated.

2. Display Driver

The major portion of the display driver 60 (driver circuit) shown in FIG. 1 or 2 is described below.

Figure 3:
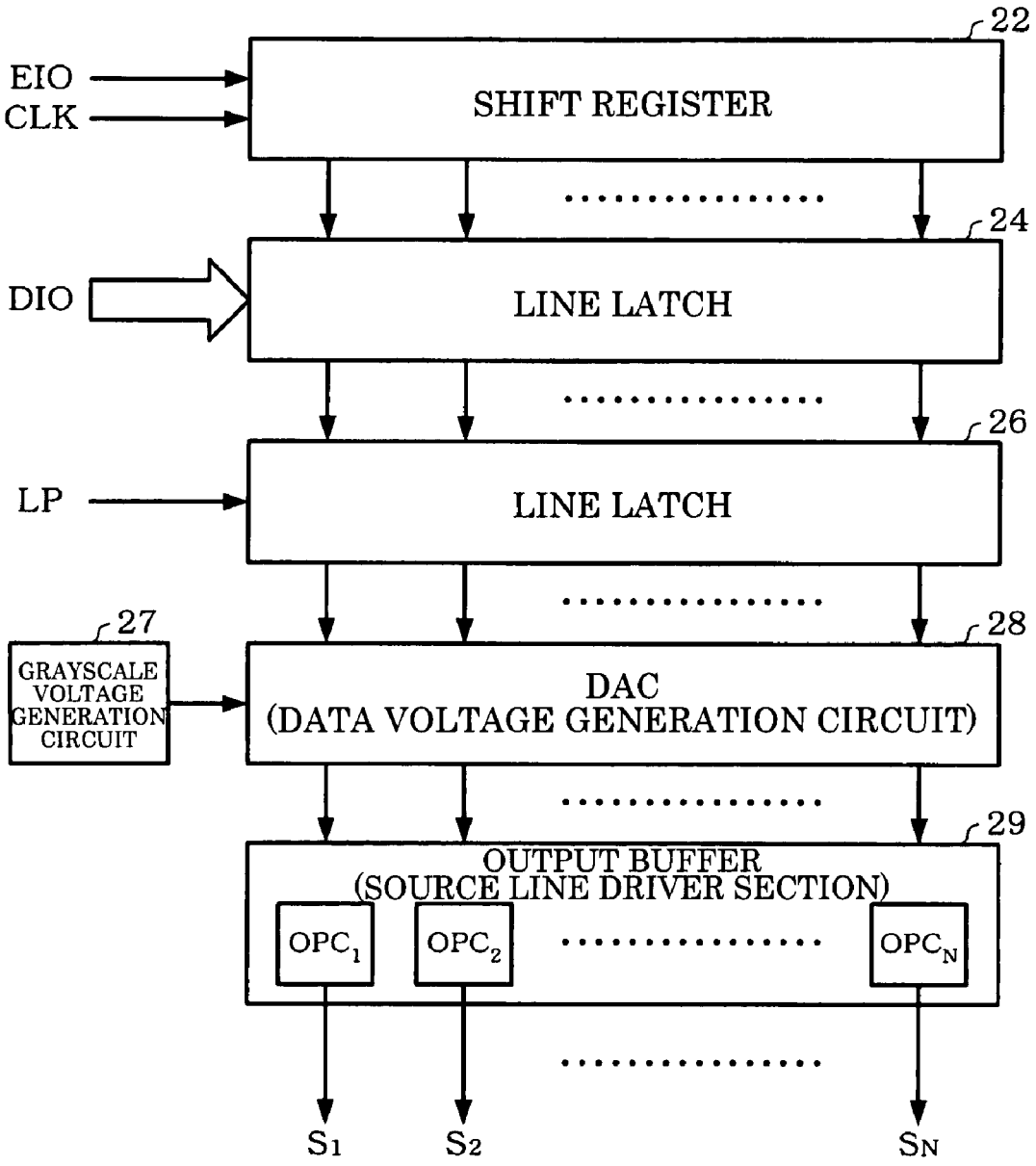
FIG. 3 is a block diagram showing a configuration example of a source line driver circuit shown in FIG. 1 or 2.

FIG. 3 is a block diagram showing a configuration example of the source line driver circuit 20 shown in FIG. 1 or 2.

The source line driver circuit 20 includes a shift register 22, line latches 24 and 26, a digital-to-analog converter (DAC) 28 (data voltage generation circuit in a broad sense), and an output buffer 29 (source line driver section in a broad sense).

The shift register 22 includes flip-flops provided corresponding to the source lines and sequentially connected. The shift register 22 holds an enable input-output signal EIO in synchronization with a clock signal CLK, and sequentially shifts the enable input-output signal EIO to the adjacent flip-flops in synchronization with the clock signal CLK.

Grayscale data (DIO) is input to the line latch 24 from the display controller 40 in units of 18 bits (6 bits (grayscale data)×3 (each color of RGB)), for example. The line latch 24 latches the grayscale data (DIO) in synchronization with the enable input-output signal EIO sequentially shifted by each flip-flop of the shift register 22.

The line latch 26 latches the grayscale data of one horizontal scan latched by the line latch 24 in synchronization with a horizontal synchronization signal LP supplied from the display controller 40.

A grayscale voltage generation circuit 27 generates 64 grayscale voltages. The 64 reference voltages generated by the grayscale voltage generation circuit 27 are supplied to the DAC 28.

The DAC 28 (data voltage generation circuit) generates an analog data voltage supplied to each source line. Specifically, the DAC 28 selects one of the grayscale voltages from the grayscale voltage generation circuit 27 based on the digital grayscale data from the line latch 26, and outputs an analog data voltage corresponding to the digital grayscale data.

The output buffer 29 buffers the data voltage from the DAC 28, and drives the source line by outputting the data voltage to the source line. Specifically, the output buffer 29 includes operational amplifier circuit blocks $OPC_1$ to $OPC_N$ provided in source line units and including a voltage-follower-connected operational amplifier. The operational amplifier circuit block subjects the data voltage from the DAC 28 to impedance conversion and outputs the resulting data voltage to the source line.

FIG. 3 employs a configuration in which the digital grayscale data is subjected to digital-analog conversion and output to the source line through the output buffer 29. A configuration may also be employed in which an analog image signal is sampled/held and output to the source line through the output buffer 29.

Figure 4:
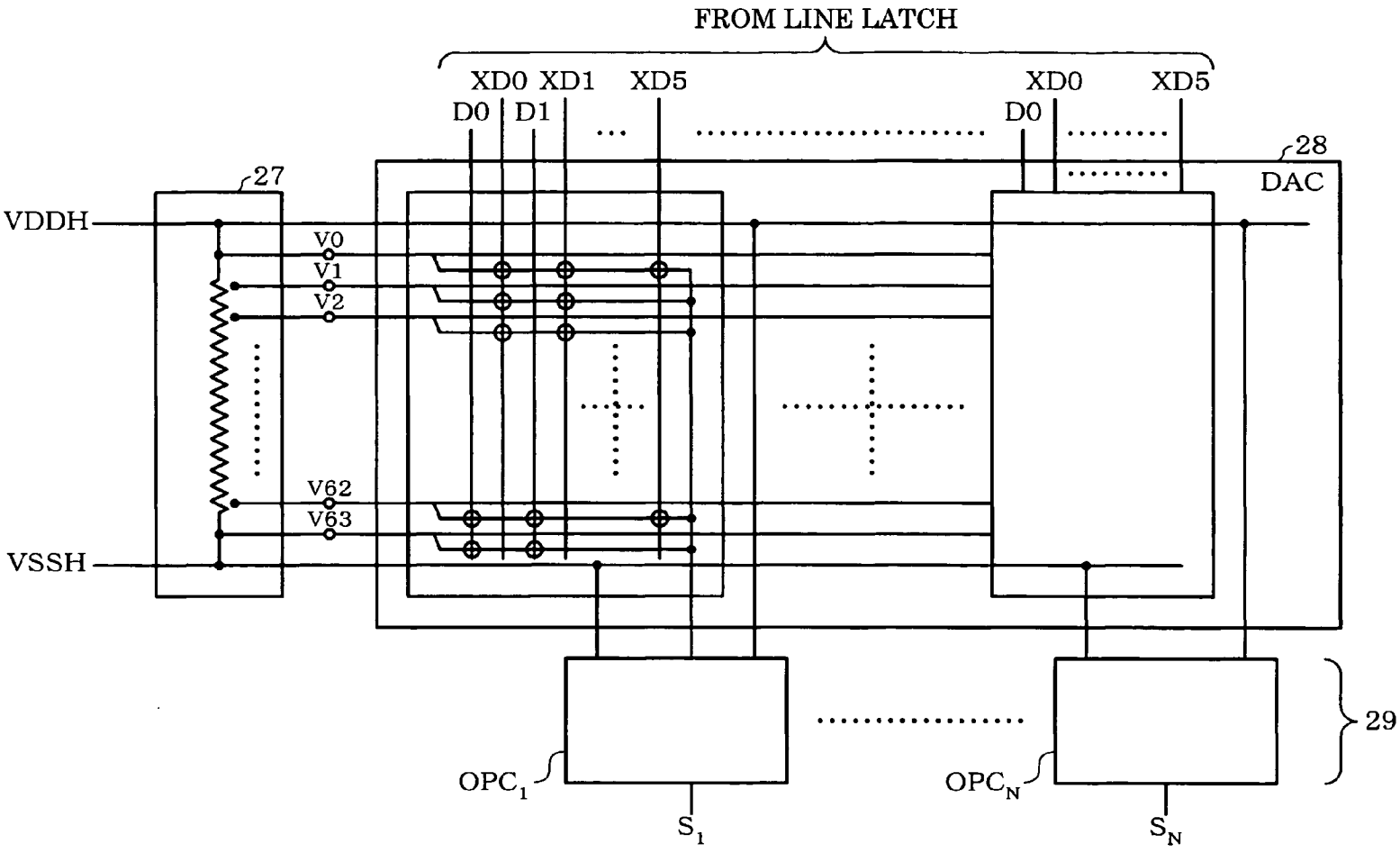
FIG. 4 is a view showing a configuration example of a grayscale voltage generation circuit, a DAC, and an output buffer shown in FIG. 3.

FIG. 4 shows a configuration example of the grayscale voltage generation circuit 27, the DAC 28, and the output buffer 29 shown in FIG. 3. In FIG. 4, the grayscale data is made up of 6-bit data D0 to D5, and inversion data of each bit of the grayscale data is indicated by XD0 to XD5. In FIG. 4, the same sections as in FIG. 3 are indicated by the same symbols. Description of these sections is appropriately omitted.

The grayscale voltage generation circuit 27 generates 64 grayscale voltages by dividing voltages VDDH and VSSH generated by the power supply circuit 50 using resistors. The grayscale voltage corresponds to each grayscale value indicated by the 6-bit grayscale data. The grayscale voltage is supplied in common to the source lines $S_1$ to $S_N$.

The DAC 28 includes decoders provided in source line units. The decoders respectively output the grayscale voltage corresponding to the grayscale data to the operational amplifier circuit blocks $OPC_1$ to $OPC_N$.

FIGS. 3 and 4 illustrate a configuration example in which the grayscale data is supplied in line units. Note that the display driver 60 may include a display memory which stores the grayscale data of at least one frame.

Figure 5:
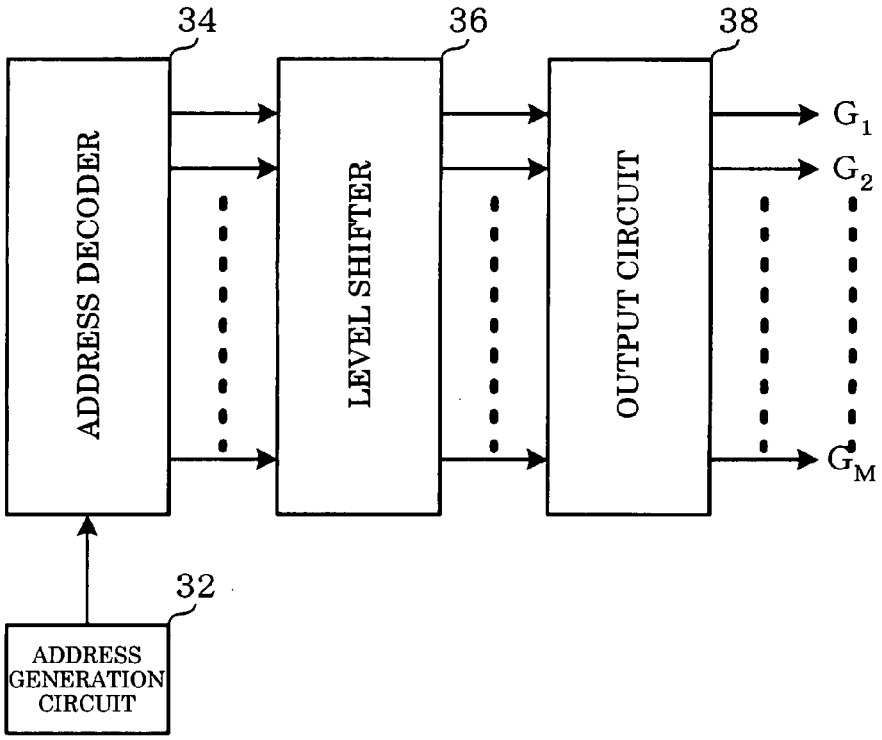
FIG. 5 is a view showing a configuration example of a gate line driver circuit shown in FIG. 1 or 2.

FIG. 5 shows a configuration example of the gate line driver circuit 30 shown in FIG. 1 or 2.

The gate line driver circuit 30 includes an address generation circuit 32, an address decoder 34, a level shifter 36, and an output circuit 38.

The address generation circuit 32 generates an address corresponding to one of the gate lines $G_1$ to $G_M$ to be selected. The address generation circuit 32 can generate an address so that the gate lines $G_1$ to $G_M$ are selected and scanned one by one.

The address decoder 34 decodes the address generated by the address generation circuit 32, and selects decode signal lines corresponding to the gate lines $G_1$ to $G_M$ based on the decoding result.

The level shifter 36 shifts the voltage level of the signal of the decode signal line from the address decoder 34 to the voltage level corresponding to the liquid crystal element of the display panel 12 and the transistor capability of the TFT. Since a high voltage level is required as the above voltage level, a high voltage process is used for the level shifter 36 differing from other logic circuit sections.

The output circuit 38 buffers a scan voltage shifted by the level shifter 36, and drives the gate line by outputting the scan voltage to the gate line.

Figure 6:
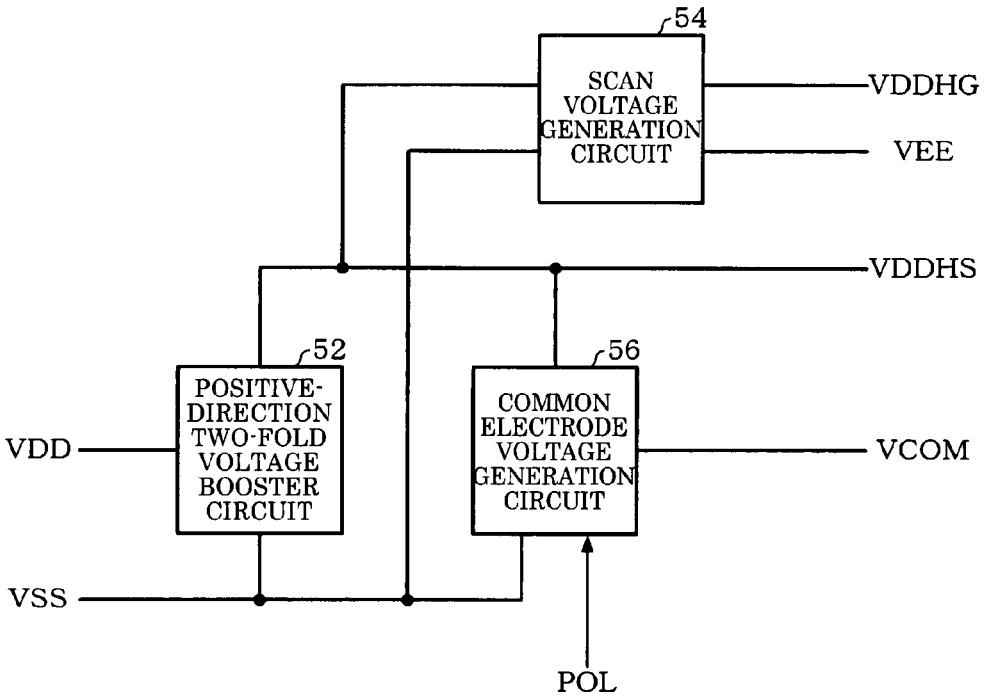
FIG. 6 is a view showing a configuration example of a power supply circuit shown in FIG. 1 or 2.

FIG. 6 shows a configuration example of the power supply circuit 50 shown in FIG. 1 or 2.

The power supply circuit 50 includes a positive-direction two-fold voltage booster circuit 52, a scan voltage generation circuit 54, and a common electrode voltage generation circuit 56. A system ground power supply voltage VSS and a system power supply voltage VDD are supplied to the power supply circuit 50.

The system ground power supply voltage VSS and the system power supply voltage VDD are supplied to the positive-direction two-fold voltage booster circuit 52. The positive-direction two-fold voltage booster circuit 52 generates a power supply voltage VDDHS by increasing the system power supply voltage VDD in the positive direction by a factor of two with respect to the system ground power supply voltage VSS. Specifically, the positive-direction two-fold voltage booster circuit 52 increases the difference between the system ground power supply voltage VSS and the system power supply voltage VDD by a factor of two. The positive-direction two-fold voltage booster circuit 52 may be formed using a charge-pump circuit. The power supply voltage VDDHS is supplied to the source line driver circuit 20, the scan voltage generation circuit 54, and the common electrode voltage generation circuit 56. It is preferable that the positive-direction two-fold voltage booster circuit 52 output the power supply voltage VDDHS obtained by increasing the system power supply voltage VDD in the positive direction by a factor of two by increasing the system power supply voltage VDD by a factor of two or more and adjusting the voltage level using a regulator.

The system ground power supply voltage VSS and the power supply voltage VDDHS are supplied to the scan voltage generation circuit 54. The scan voltage generation circuit 54 generates a scan voltage. The scan voltage is a voltage applied to the gate line selected by the gate line driver circuit 30. The high-potential-side scan voltage and the low-potential-side scan voltage are voltages VDDHG and VEE, respectively.

The common electrode voltage generation circuit 56 generates the common electrode voltage VCOM. The common electrode voltage generation circuit 56 outputs the high-potential-side voltage VCOMH or the low-potential-side voltage VCOML as the common electrode voltage VCOM based on a polarity inversion signal POL. The polarity inversion signal POL is generated by the display controller 40 in synchronization with the polarity inversion timing.

Figure 7:
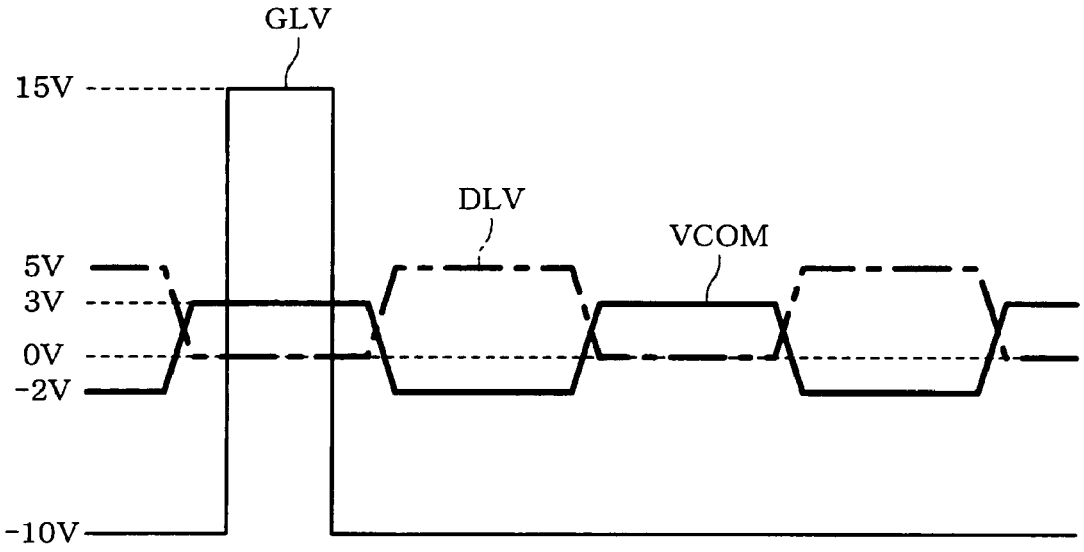
FIG. 7 is a view showing an example of a drive waveform of a display panel shown in FIG. 1 or 2.

FIG. 7 shows an example of a drive waveform of the display panel 12 shown in FIG. 1 or 2.

A grayscale voltage DLV corresponding to the grayscale value of the grayscale data is applied to the source line. In FIG. 7, the grayscale voltage DLV having an amplitude of 5V with respect to the system ground power supply voltage VSS (=0V) is applied.

A scan voltage GLV at a low-potential-side voltage VEE (=−10V) is applied to the gate line in an unselected state, and a scan voltage GLV at a high-potential-side voltage VDDHG (=15V) is applied to the gate line in a selected state.

The common electrode voltage VCOM at a high-potential-side voltage VCOMH (=3V) or a low-potential-side voltage VCOML (=−2V) is applied to the common electrode CE. The polarity of the voltage level of the common electrode voltage VCOM is reversed with respect to a given voltage in synchronization with the polarity inversion timing. FIG. 7 shows the waveform of the common electrode voltage VCOM during scan line inversion drive. The polarity of the grayscale voltage DLV applied to the source line is also reversed with respect to a given voltage in synchronization with the polarity inversion timing.

The liquid crystal element deteriorates when a direct-current voltage is applied to the liquid crystal element for a long period of time. This makes it necessary to employ a drive method in which the polarity of the voltage applied to the liquid crystal element is reversed in units of specific periods. As such a drive method, frame inversion drive, scan (gate) line inversion drive, data (source) line inversion drive, dot inversion drive, and the like can be given.

Data line inversion drive and dot inversion drive ensure an excellent image quality, but require a high voltage for driving the display panel. Frame inversion drive results in an insufficient image quality, but can reduce power consumption. For example, frame inversion drive can reduce the frequency of the common electrode voltage to a large extent. Therefore, frame inversion drive can significantly reduce power consumption accompanying driving the common electrode as compared with data line inversion drive and dot inversion drive.

In this embodiment, the common electrode can be driven in an arbitrary polarity inversion drive mode. For example, when image quality is given priority, the common electrode voltage is set so that the common electrode is driven by scan line inversion drive (hereinafter simply called "line inversion drive"), whereby the common electrode can be driven by line inversion drive. When a reduction in power consumption is given priority, the common electrode voltage is set so that the common electrode is driven by frame inversion drive, whereby the common electrode can be driven by frame inversion drive.

In line inversion drive, the polarity of the voltage applied to the liquid crystal element is reversed in units of scan periods (gate lines). For example, a positive voltage is applied to the liquid crystal element in the first scan period (gate line), a negative voltage is applied to the liquid crystal element in the second scan period, and a positive voltage is applied to the liquid crystal element in the third scan period. In the subsequent frame, a negative voltage is applied to the liquid crystal element in the first scan period, a positive voltage is applied to the liquid crystal element in the second scan period, and a negative voltage is applied to the liquid crystal element in the third scan period.

In line inversion drive, the polarity of the voltage level of the common electrode voltage VCOM applied to the common electrode CE is reversed in units of scan periods (scan lines).

Figure 8:
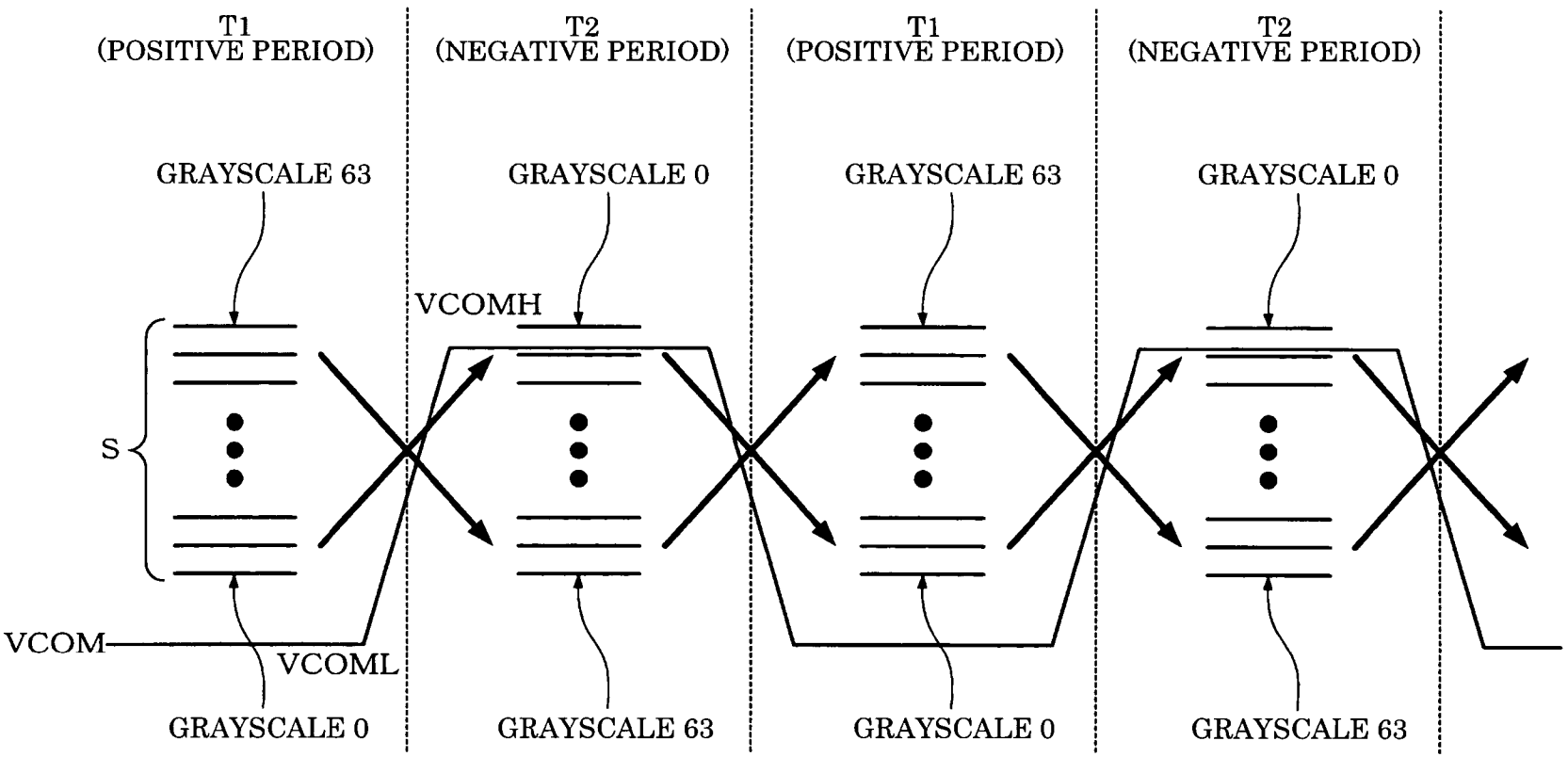
FIG. 8 is a view illustrative of scan line inversion drive.

Specifically, the voltage level of the common electrode voltage VCOM is set at the low-potential-side voltage VCOML in a positive period T1 (first period) and is set at the high-potential-side voltage VCOMH in a negative period T2 (second period), as shown in FIG. 8. The polarity of the grayscale voltage applied to the source line is also reversed at the above timing. The low-potential-side voltage VCOML is a voltage level obtained by reversing the polarity of the high-potential-side voltage VCOMH with respect to a given voltage level.

The positive period T1 is a period in which the voltage level of the pixel electrode to which the grayscale voltage is supplied through the source line becomes higher than the voltage level of the common electrode CE. In the period T1, a positive voltage is applied to the liquid crystal element. The negative period T2 is a period in which the voltage level of the pixel electrode to which the grayscale voltage is supplied through the source line becomes lower than the voltage level of the common electrode CE. In the period T2, a negative voltage is applied to the liquid crystal element.

In frame inversion drive, the polarity of the voltage level of the common electrode voltage VCOM applied to the common electrode CE is reversed in units of vertical scan periods (frame periods).

The voltage necessary for driving the display panel can be reduced by thus reversing the polarity of the common electrode voltage VCOM. This makes it possible to reduce the withstand voltage of the driver circuit, whereby the manufacturing process of the driver circuit can be simplified and the manufacturing cost can be reduced.

2.1 Charge Recycle

In this embodiment, the source line can be driven at low power consumption without externally charging/discharging the source line by utilizing charges stored in the second capacitor element CCS using the source output switch circuits $SSW_1$ to $SSW_N$, the source charge storage switch CSW, and the second capacitor element CCS. Specifically, power consumption is further reduced by reducing unnecessary external charging/discharging.

In this embodiment, the common electrode can be driven at low power consumption without externally charging/discharging the common electrode by utilizing charges stored in the first capacitor element CCV using the common electrode charge storage switch VSW and the first capacitor element CCV. Specifically, power consumption is further reduced by reducing unnecessary external charging/discharging.

Figure 9:
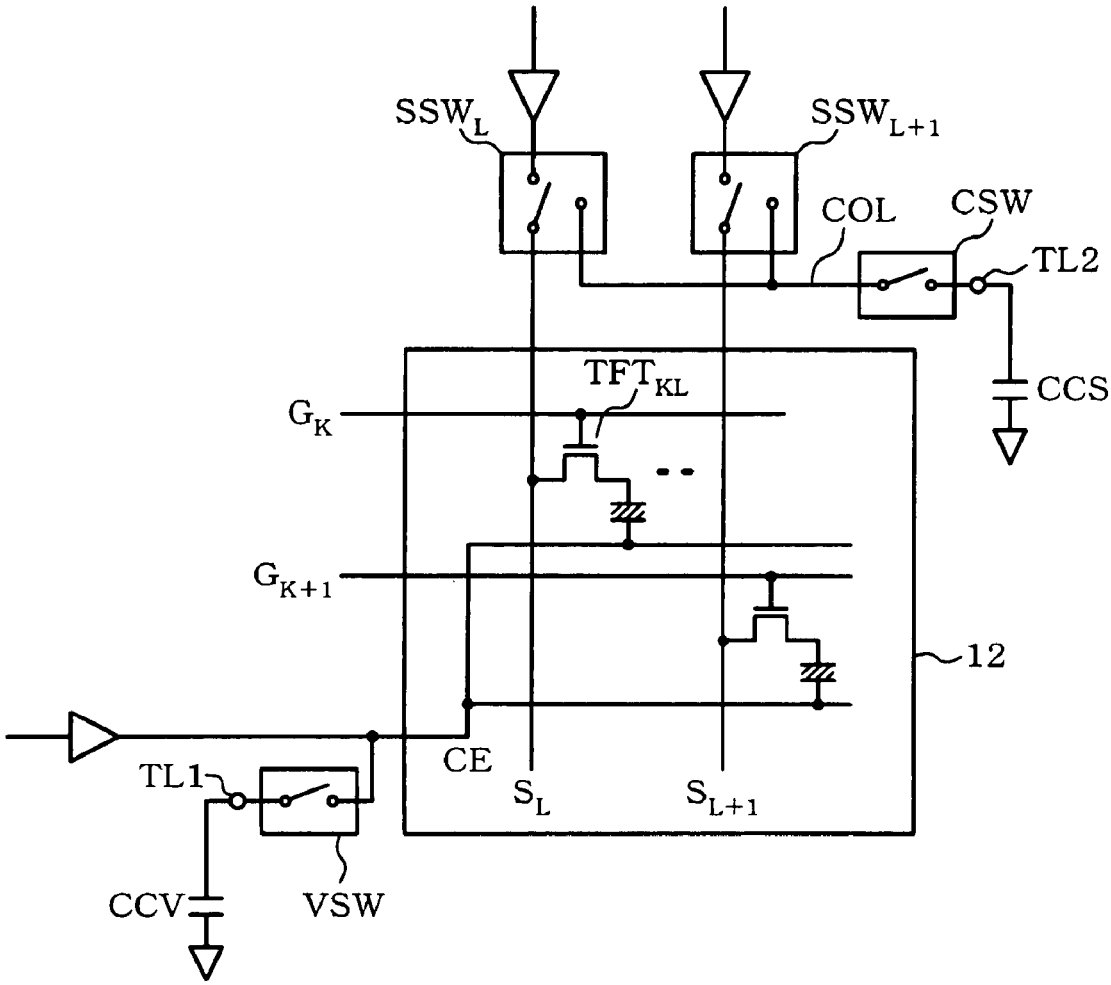
FIG. 9 is a fundamental configuration diagram of a liquid crystal device according to one embodiment of the invention.

FIG. 9 is a fundamental configuration diagram of the liquid crystal device 10 according to this embodiment.

In FIG. 9, the same sections as in FIG. 1 or 2 are indicated by the same symbols. Description of these sections is appropriately omitted. FIG. 9 shows an electric equivalent circuit of the pixel provided at the intersection of the gate line $G_K$ and the source line $S_L$ and an electric equivalent circuit of the pixel provided at the intersection of the gate line $G_{K+1}$ and the source line $S_{L+1}$. The electric equivalent circuits of other pixels are the same as those shown in FIG. 9. FIG. 9 shows only the source output switch circuit of the source line driver circuit 20, the source charge storage switch CSW, and the common electrode charge storage switch VSW.

Figure 10:
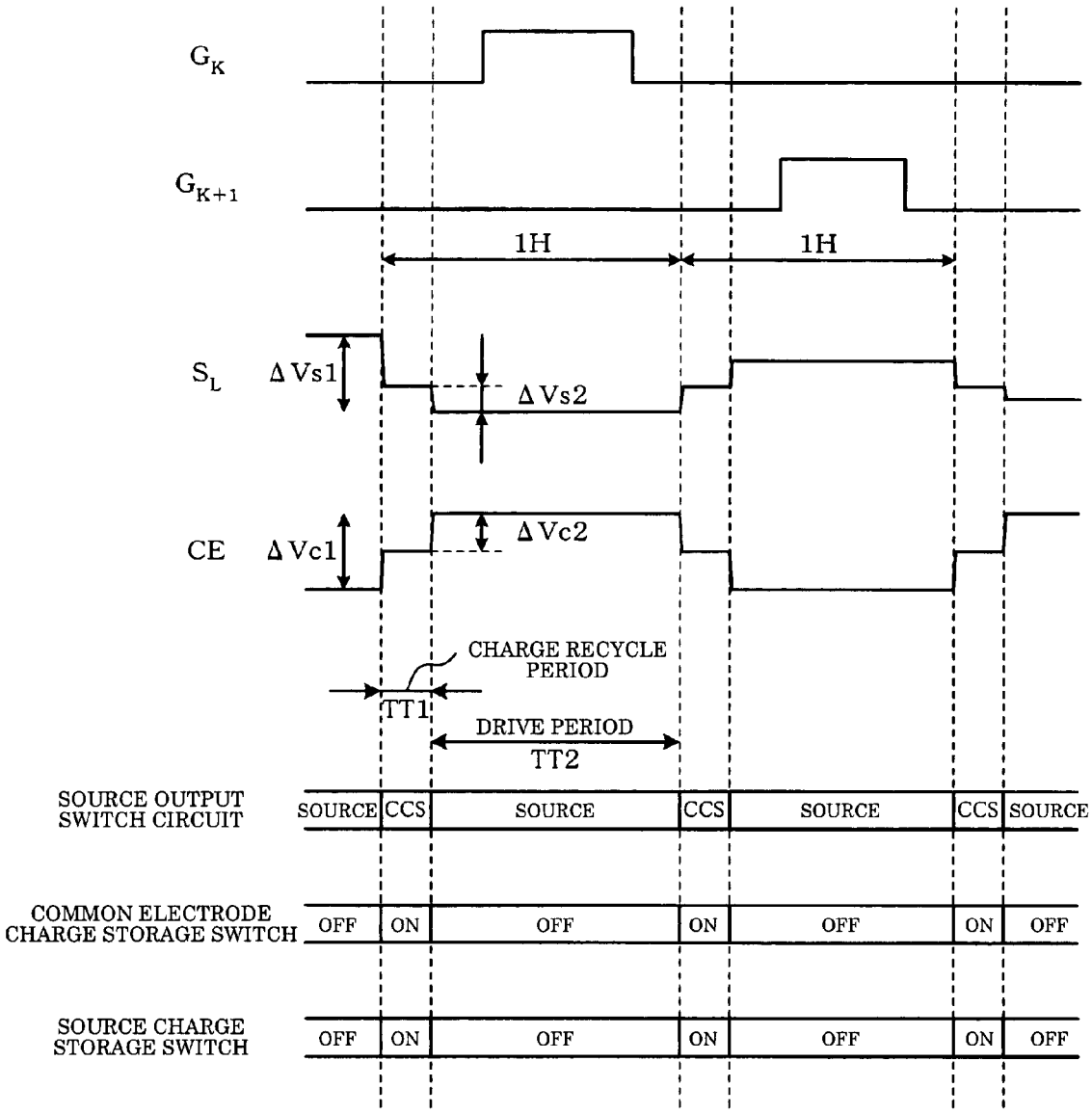
FIG. 10 is a waveform diagram showing an operation example of the liquid crystal device shown in FIG. 9 when performing line inversion drive.

FIG. 10 is a waveform diagram showing an operation example of the liquid crystal device 10 shown in FIG. 9 when performing line inversion drive.

FIG. 10 shows changes in potentials of the gate lines $G_K$ and $G_{K+1}$, the source line $S_L$, and the common electrode CE. Note that the same waveforms apply to other gate lines and source lines. In FIG. 10, the scan voltage is applied to the gate line $G_K$ within one horizontal scan period (1H) which is a select period of the pixel connected with the gate line $G_K$, and the scan voltage is applied to the gate line $G_{K+1}$ within one horizontal scan period which is a select period of the pixel connected with the gate line $G_{K+1}$. Each horizontal scan period includes a charge recycle period provided in the first period and a drive period provided in the second period. The source output switch circuits $SSW_L$ and $SSW_{L+1}$, the common electrode charge storage switch VSW, and the source charge storage switch CSW are switched when the charge recycle period transitions to the drive period and when the drive period transitions to the charge recycle period.

In the charge recycle period (TT1), the source lines $S_L$ and $S_{L+1}$ are electrically connected with the common line COL including the second capacitor element connection node through the source output switch circuits $SSW_L$ and $SSW_{L+1}$, respectively. The source charge storage switch CSW is set in a conducting state, whereby the common line COL is electrically connected with one end of the second capacitor element CCS through the second capacitor element connection terminal TL2. Therefore, one end of the second capacitor element CCS and the source lines $S_L$ and $S_{L+1}$ are set at the same potential in the charge recycle period, whereby charges stored in parasitic capacitors of the source lines are supplied to one end of the second capacitor element CCS, or charges stored in the second capacitor element CCS are charged into parasitic capacitors of the source lines $S_L$ and $S_{L+1}$ according to the charge conservation law. Specifically, the potentials of the source lines are changed in the charge recycle period without supplying charges from the power supply circuit 50.

In the charge recycle period, since the output of the common electrode voltage generation circuit (not shown) is set in a high impedance state and the common electrode charge storage switch VSW is set in a conducting state, the common electrode CE is electrically connected with one end of the first capacitor element CCV through the first capacitor element connection terminal TL1. Therefore, one end of the first capacitor element CCV and the common electrode CE are set at the same potential in the charge recycle period, whereby charges stored in a parasitic capacitor of the common electrode CE are supplied to one end of the first capacitor element CCV, or charges stored in the first capacitor element CCV are charged into a parasitic capacitor of the common electrode CE. Specifically, the potential of the common electrode CE is changed in the charge recycle period without supplying charges from the power supply circuit 50.

In the drive period (TT2) after the charge recycle period, the source lines $S_L$ and $S_{L+1}$ are electrically connected with the outputs of the output buffers of the source line driver circuit 20 through the source output switch circuits $SSW_L$ and $SSW_{L+1}$, respectively. The source charge storage switch CSW is set in a nonconducting state. Therefore, the source lines $S_L$ and $S_{L+1}$ are driven by the output buffers of the source line driver circuit 20 in the drive period. In this case, the output buffer of the source line driver circuit 20 charges/discharges the source line until each source line is set at a potential corresponding to the display data with respect to the potential set in the charge recycle period TT1. Accordingly, the voltage of the source line generally need not be changed to a large extent by the output buffer of the source line driver circuit 20 in the drive period after the charge recycle period. Specifically, when setting the potential of the source line in the present horizontal scan period (select period of the pixel connected with the gate line $G_K$) based on the potential of the source line in the preceding horizontal scan period (select period of the pixel connected with the gate line $G_{K-1}$), the output buffer of the source line driver circuit 20 must charge/discharge the source line by ΔVs1, as shown in FIG. 10. On the other hand, it suffices that the output buffer of the source line driver circuit 20 charge/discharge the source line by ΔVs2 (ΔVs2<ΔVs1) by providing the charge recycle period, as shown in FIG. 10.

In the drive period (TT2) after the charge recycle period, the common electrode charge storage switch VSW is set in a nonconducting state, whereby the common electrode CE is electrically connected with the output of the common electrode voltage generation circuit 56 of the power supply circuit 50. Therefore, the common electrode voltage VCOM from the common electrode voltage generation circuit 56 is supplied to the common electrode CE in the drive period. In this case, the common electrode voltage generation circuit 56 charges/discharges the common electrode CE until the high-potential-side voltage VCOMH is reached with respect to the potential set in the charge recycle period TT1. Accordingly, the voltage of the common electrode CE need not be changed to a large extent by the common electrode voltage generation circuit 56 in the drive period after the charge recycle period. Specifically, when setting the potential of the common electrode CE in the present horizontal scan period (select period of the pixel connected with the gate line $G_K$) based on the potential of the common electrode CE in the preceding horizontal scan period (select period of the pixel connected with the gate line $G_{K-1}$), the common electrode voltage generation circuit 56 must charge/discharge the common electrode CE by ΔVc1, as shown in FIG. 10. On the other hand, it suffices that the common electrode voltage generation circuit 56 charge/discharge the common electrode CE by ΔVc2 (ΔVc2<ΔVc1) by providing the charge recycle period, as shown in FIG. 10.

The charge recycle period and the drive period are also provided in the subsequent horizontal scan period, and the above-described operation is performed in each period. Since power consumption accompanying driving the source line in the charge recycle period depends on the voltage (i.e. display data) set by the source line driver circuit 20 in the drive period, the effect of reducing power consumption by charge recycle is reduced. On the other hand, since the common electrode CE is set at the high-potential-side voltage VCOMH or the low-potential-side voltage VCOML, power consumption can be reliably reduced using a simple configuration independent of the display data, whereby the effect of reducing power consumption by charge recycle is remarkably increased.

Figure 11:
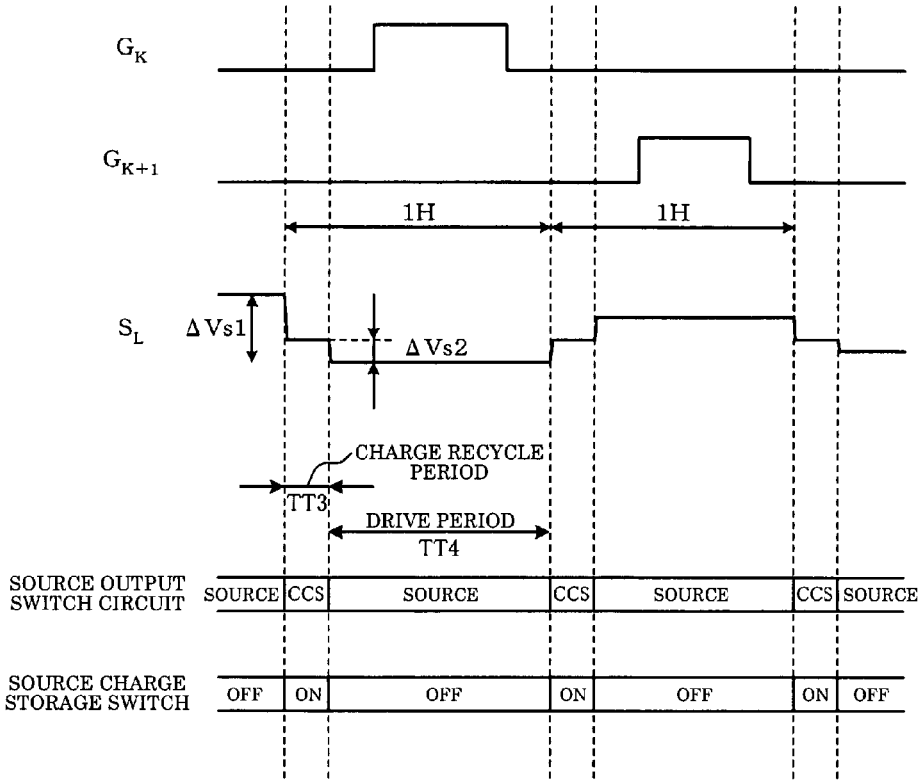
FIG. 11 is a waveform diagram showing an operation example of the liquid crystal device shown in FIG. 9 when performing frame inversion drive.
Figure 12:
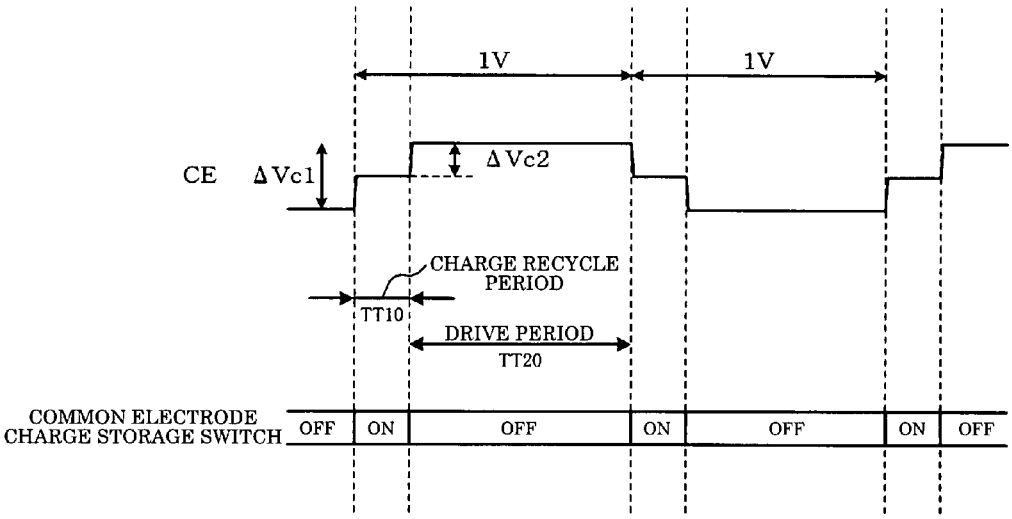
FIG. 12 is a waveform diagram showing another operation example of the liquid crystal device shown in FIG. 9 when performing frame inversion drive.

FIGS. 11 and 12 are waveform diagrams showing an operation example of the liquid crystal device 10 shown in FIG. 9 when performing frame inversion drive.

FIG. 11 shows changes in potentials of the gate lines $G_K$ and $G_{K+1}$, and the source line $S_L$. Note that the same waveforms apply to other gate lines and source lines. In FIG. 11, the scan voltage is applied to the gate line $G_K$ within one horizontal scan period (1H) which is a select period of the pixel connected with the gate line $G_K$, and the scan voltage is applied to the gate line $G_{K+1}$ within one horizontal scan period which is a select period of the pixel connected with the gate line $G_{K+1}$. Each horizontal scan period includes a charge recycle period provided in the first period and a drive period provided in the second period. The source output switch circuits $SSW_L$ and $SSW_{L+1}$ and the source charge storage switch CSW are switched when the charge recycle period transitions to the drive period and when the drive period transitions to the charge recycle period.

When recycling charges, the source lines $S_L$ and $S_{L+1}$ are electrically connected with the common line COL including the second capacitor element connection node through the source output switch circuits $SSW_L$ and $SSW_{L+1}$, respectively, in the charge recycle period (TT3). The source charge storage switch CSW is set in a conducting state, whereby the common line COL is electrically connected with one end of the second capacitor element CCS through the second capacitor element connection terminal TL2. Therefore, one end of the second capacitor element CCS and the source lines $S_L$ and $S_{L+1}$ are set at the same potential in the charge recycle period, whereby charges stored in parasitic capacitors of the source lines are supplied to one end of the second capacitor element CCS, or charges stored in the second capacitor element CCS are charged into parasitic capacitors of the source lines $S_L$ and $S_{L+1}$ according to the charge conservation law. Specifically, the potentials of the source lines are changed in the charge recycle period without supplying charges from the power supply circuit 50.

In the drive period (TT4) after the charge recycle period, the source lines $S_L$ and $S_{L+1}$ are electrically connected with the outputs of the output buffers (source line driver sections) of the source line driver circuit 20 through the source output switch circuits $SSW_L$ and $SSW_{L+1}$, respectively. The source charge storage switch CSW is set in a nonconducting state. Therefore, the source lines $S_L$ and $S_{L+1}$ are driven by the output buffers of the source line driver circuit 20 in the drive period. In this case, the output buffer of the source line driver circuit 20 charges/discharges the source line until each source line is set at a potential corresponding to the grayscale data with respect to the potential set in the charge recycle period TT3. Accordingly, the voltage of the source line generally need not be changed to a large extent by the output buffer of the source line driver circuit 20 in the drive period after the charge recycle period. Specifically, when setting the potential of the source line in the present horizontal scan period (select period of the pixel connected with the gate line $G_K$) based on the potential of the source line in the preceding horizontal scan period (select period of the pixel connected with the gate line $G_{K-1}$), the output buffer of the source line driver circuit 20 must charge/discharge the source line by ΔVs1, as shown in FIG. 11. On the other hand, it suffices that the output buffer of the source line driver circuit 20 charge/discharge the source line by ΔVs2 (ΔVs2<ΔVs1) by providing the charge recycle period, as shown in FIG. 11.

The charge recycle period and the drive period are also provided in the subsequent horizontal scan period, and the above-described operation is performed in each period.

The voltage applied to the source line varies depending on the type of display image. Therefore, the voltage applied to the source line varies depending on the grayscale data of the charge recycle target source line. In general, when the second capacitor element CCS is repeatedly charged/discharged, the voltage corresponding to the charges stored in the second capacitor element CCS converges to the grayscale voltage corresponding to the intermediate grayscale value. For example, when the number of grayscales is 64, the voltage converges to the grayscale voltage corresponding to the grayscale value 32 (intermediate grayscale value).

FIG. 12 shows a change in potential of the common electrode CE. In FIG. 12, one vertical scan period (1V) includes a charge recycle period provided in the first period and a drive period provided in the second period. The common electrode charge storage switch VSW is switched when the charge recycle period transitions to the drive period and when the drive period transitions to the charge recycle period.

In the charge recycle period (TT10), the output of the common electrode voltage generation circuit (not shown) is set in a high impedance state, and the common electrode charge storage switch VSW is set in a conducting state. Therefore, the common electrode CE is electrically connected with one end of the first capacitor element CCV through the first capacitor element connection terminal TL1. Therefore, one end of the first capacitor element CCV and the common electrode CE are set at the same potential in the charge recycle period, whereby charges stored in a parasitic capacitor of the common electrode CE are supplied to one end of the first capacitor element CCV, or charges stored in the first capacitor element CCV are charged into a parasitic capacitor of the common electrode CE. Specifically, the potential of the common electrode CE is changed in the charge recycle period without supplying charges from the power supply circuit 50.

In the drive period (TT20) after the charge recycle period, the common electrode charge storage switch VSW is set in a nonconducting state, and the common electrode CE is electrically connected with the output of the common electrode voltage generation circuit 56 of the power supply circuit 50. Therefore, the common electrode voltage VCOM from the common electrode voltage generation circuit 56 is supplied to the common electrode CE in the drive period. In this case, the common electrode voltage generation circuit 56 charges and discharges the common electrode CE until the high-potential-side voltage VCOMH is reached with respect to the potential set in the charge recycle period TT10. Accordingly, the voltage of the common electrode CE need not be changed to a large extent by the common electrode voltage generation circuit 56 in the drive period after the charge recycle period. Specifically, when setting the potential of the common electrode CE in the present vertical scan period based on the potential of the common electrode CE in the preceding vertical scan period, the common electrode voltage generation circuit 56 must charge/discharge the common electrode CE by ΔVc1, as shown in FIG. 12. On the other hand, it suffices that the common electrode voltage generation circuit 56 charge/discharge the common electrode CE by ΔVc2 (ΔVc2<ΔVc1) by providing the charge recycle period, as shown in FIG. 12.

The charge recycle period and the drive period are also provided in the subsequent vertical scan period, and the above-described operation is performed in each period.

2.2 Charge Recycle Control

Since the common electrode CE is set at the high-potential-side voltage VCOMH or the low-potential-side voltage VCOML, power consumption can be reliably reduced using a simple configuration independent of the grayscale data, whereby the effect of reducing power consumption by charge recycle is remarkably increased. On the other hand, since power consumption accompanying driving the source line in the charge recycle period shown in FIGS. 10 and 11 depends on the voltage (i.e. grayscale data) set by the source line driver circuit 20 in the drive period, the effect of reducing power consumption by charge recycle is reduced. In this embodiment, when performing line inversion drive, whether or not to recycle charges is determined in source line units based on the grayscale data and the polarity of the common electrode voltage, and charges are recycled or charge recycle is omitted in source line units based on the determination result. When performing frame inversion drive, whether or not to recycle charges is determined in source line units based on the grayscale voltages corresponding to the grayscale data in two consecutive horizontal scan periods, and charges are recycled or charge recycle is omitted in source line units based on the determination result.

Figures 13, 14:
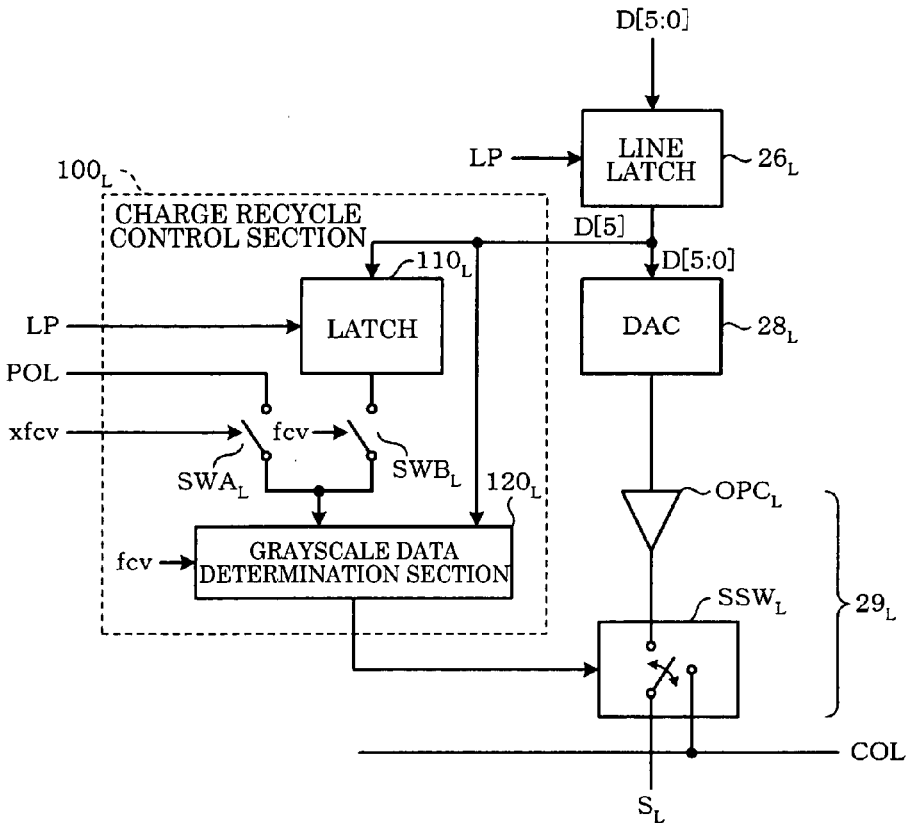
FIG. 13 is a view showing the major portion of the configuration of the source line driver circuit shown in FIG. 3.
FIG. 14 is a view illustrative of a control example of a charge recycle control section shown in FIG. 13 when performing line inversion drive.

FIG. 13 shows the major portion of the configuration of the source line driver circuit 20 shown in FIG. 3.

FIG. 13 shows a configuration example of one output of the source line driver circuit 20 for driving the source line $S_L$. Note that other source outputs have the same configuration. In FIG. 13, the source line driver circuit 20 includes the common line COL. The same sections as in FIG. 3 are indicated by the same symbols to which the character "L" corresponding to the source line $S_L$ is attached. Description of these sections is appropriately omitted.

In FIG. 13, the source line driver circuit 20 includes charge recycle control sections $\mathbf{100}_1$ to $\mathbf{100}_L$ provided in source output units in addition to the shift register 22, the line latches 24 and 26, the grayscale voltage generation circuit 27, the DAC 28, and the output buffer 29. The source output switch circuits $SSW_1$ to $SSW_N$ shown in FIG. 9 are provided in the output buffer 29.

In FIG. 13, grayscale data D[5:0] held by the line latch $\mathbf{24}_L$ (not shown) formed of the flip-flop of the line latch 24 provided corresponding to the source line $S_L$ is held by the line latch $\mathbf{26}_L$ formed of the flip-flop of the line latch 26 provided corresponding to the source line $S_L$ at the change timing of the horizontal synchronization signal LP. The grayscale data D[5:0] held by the line latch 26L is output to the DAC $\mathbf{28}_L$. The DAC $\mathbf{28}_L$ outputs a grayscale voltage which is an analog voltage corresponding to the grayscale data D[5:0] from the line latch $\mathbf{26}_L$. The operational amplifier of the operational amplifier circuit block $OPC_L$ subjects the grayscale voltage from the DAC $\mathbf{28}_L$ to impedance conversion, and drives the source line $S_L$. The source output switch circuit $SSW_L$ is provided between the operational amplifier circuit block $OPC_L$ and the source line $S_L$ of the display panel 12.

In FIG. 13, the charge recycle control section $\mathbf{100}_L$ is provided corresponding to the source line $S_L$. The charge recycle control section $\mathbf{100}_L$ controls switching of the source output switch circuit $SSW_L$.

The source line driver circuit 20 may include the source output switch circuit $SSW_L$ for short-circuiting the source line $S_L$ and the common line COL before the source line SL is driven by the output buffer (source line driver section), and the charge recycle control section $\mathbf{100}_L$ which controls the source output switch circuit $SSW_L$. The common line COL is electrically connected with one end of the second capacitor element (capacitor in a broad sense) CCS. When performing line inversion drive, the charge recycle control section $\mathbf{100}_L$ determines whether or not to short-circuit the source line $S_L$ and the common line COL in source output units based on the grayscale data and the polarity of the common electrode voltage VCOM supplied to the common electrode CE. When performing frame inversion drive, the charge recycle control section $\mathbf{100}_L$ determines whether or not to short-circuit (electrically connect) the source line and the common line COL in source output units based on a first grayscale voltage supplied to the source line in the preceding horizontal scan period and a second grayscale voltage supplied to the source line in the present horizontal scan period. The source output switch circuit $SSW_L$ short-circuits the source line $S_L$ and the common line COL based on the determination result of the charge recycle control section $\mathbf{100}_L$ irrespective of line inversion drive and frame inversion drive.

Specifically, when performing line inversion drive, the charge recycle control section $\mathbf{100}_L$ determines whether or not the grayscale voltage supplied to the source line $S_L$ in the present horizontal scan period is higher in potential than a given reference voltage Vref when the common electrode voltage VCOM changes (when the common electrode voltage VCOM changes from the high-potential-side voltage VCOMH to the low-potential-side voltage VCOML or when the common electrode voltage VCOM changes from the low-potential-side voltage VCOML to the high-potential-side voltage VCOMH). When the charge recycle control section $\mathbf{100}_L$ has determined that the grayscale voltage supplied to the source line $S_L$ in the present horizontal scan period is lower in potential than the reference voltage Vref when the common electrode voltage VCOM changes from the low-potential-side voltage VCOML to the high-potential-side voltage VCOMH, or has determined that the grayscale voltage is higher in potential than the reference voltage Vref when the common electrode voltage VCOM changes from the high-potential-side voltage VCOMH to the low-potential-side voltage VCOML, the source output switch circuit $SSW_L$ short-circuits the source line $S_L$ and the common line COL.

When performing frame inversion drive, the charge recycle control section $\mathbf{100}_L$ determines whether or not the first and second grayscale voltages are higher or lower in potential than a given reference voltage in source output units. When the charge recycle control section $\mathbf{100}_L$ has determined that the first and second grayscale voltages are higher or lower in potential than the reference voltage, the source output switch circuit $SSW_L$ short-circuits the source line $S_L$ and the common line COL. Specifically, the charge recycle control section $\mathbf{100}_L$ compares data of the most significant bit (MSB) of the first grayscale data for generating the first grayscale voltage and data of the most significant bit of the second grayscale data for generating the second grayscale voltage, and determines whether or not to short-circuit the source line $S_L$ and the common line COL based on the comparison result.

The charge recycle control section $\mathbf{100}_L$ may include a latch $\mathbf{110}_L$, a grayscale data determination section $\mathbf{120}_L$, and switch circuits $SWA_L$ and $SWB_L$. The latch $\mathbf{110}_L$ latches the MSB data D[5] of the grayscale data from the line latch $\mathbf{26}_L$ at the change timing of the horizontal synchronization signal LP.

The source line driver circuit 20 includes a polarity inversion drive mode setting register (not shown). The display controller 40 or the host (not shown) sets control data corresponding to line inversion drive or control data corresponding to frame inversion drive in the polarity inversion drive mode setting register. The source line driver circuit 20 performs line inversion drive or frame inversion drive corresponding to the control data set in the polarity inversion drive mode setting register. Control signals fcv and xfcv corresponding to the control data set in the polarity inversion drive mode setting register are supplied to the charge recycle control section $\mathbf{100}_L$. The control signal xfcv is an inversion signal of the control signal fcv. When setting frame inversion drive, the control signal fcv is set at the H level so that the switch circuit $SWA_L$ is set in a nonconducting state and the switch circuit $SWB_L$ is set in a conducting state. When setting line inversion drive, the control signal fcv is set at the L level so that the switch circuit $SWA_L$ is set in a conducting state and the switch circuit $SWB_L$ is set in a nonconducting state.

When performing line inversion drive, the grayscale data determination section $\mathbf{120}_L$ compares the polarity inversion signal POL and the data D[5] from the line latch $\mathbf{26}_L$. The polarity inversion signal POL is a signal which specifies the polarity of the common electrode voltage generated by the display controller 40, for example. The data D[5] from the latch $\mathbf{110}_L$ is the MSB data of the grayscale data in the horizontal scan period (line) immediately before the present horizontal scan period (present line).

When performing frame inversion drive, the grayscale data determination section $\mathbf{120}_L$ compares the data D[5] from the latch $\mathbf{110}_L$ and the data D[5] from the line latch $\mathbf{26}_L$. The data D[5] from the latch $\mathbf{110}_L$ is the MSB data of the grayscale data in the horizontal scan period (line) immediately before the present horizontal scan period (present line).

A comparison result signal from the grayscale data determination section $\mathbf{120}_L$ is supplied to the source output switch circuit $SSW_L$. The source output switch circuit $SSW_L$ is switch-controlled based on the comparison result signal from the grayscale data determination section $\mathbf{120}_L$.

2.2.1 Line Inversion Drive

FIG. 14 is a view illustrative of a control example of the charge recycle control section $\mathbf{100}_L$ shown in FIG. 13 when performing line inversion drive.

FIG. 14 shows an example in which the display panel 12 is normally white. Note that the charge recycle control section $\mathbf{100}_L$ can similarly control charge recycle when the display panel 12 is normally black.

When the grayscale data determination section $\mathbf{120}_L$ has determined that the common electrode voltage VCOM in the preceding line is the low-potential-side voltage VCOML and the common electrode voltage VCOM in the present line is the high-potential-side voltage VCOMH, the charge recycle control section $\mathbf{100}_L$ controls the source output switch circuit $SSW_L$ so that the source output switch circuit $SSW_L$ short-circuits the source line $S_L$ and the common line COL to recycle charges, on condition that the MSB data of the grayscale data in the present line is "1" ("0" when the display panel 12 is normally black). When the grayscale data determination section $\mathbf{120}_L$ has determined that the common electrode voltage VCOM in the preceding line is the low-potential-side voltage VCOML and the common electrode voltage VCOM in the present line is the high-potential-side voltage VCOMH, the charge recycle control section $\mathbf{100}_L$ controls the source output switch circuit $SSW_L$ so that the source output switch circuit $SSW_L$ does not short-circuit the source line $S_L$ and the common line COL and does not recycle charges on condition that the MSB data of the grayscale data in the present line is "0" ("1" when the display panel 12 is normally black). When "1" is referred to as first data, "0" may be referred to as second data or inversion data of the first data.

When the grayscale data determination section $\mathbf{120}_L$ has determined that the common electrode voltage VCOM in the preceding line is the high-potential-side voltage VCOMH and the common electrode voltage VCOM in the present line is the low-potential-side voltage VCOML, the charge recycle control section $\mathbf{100}_L$ controls the source output switch circuit $SSW_L$ so that the source output switch circuit $SSW_L$ short-circuits the source line $S_L$ and the common line COL to recycle charges on condition that the MSB data of the grayscale data in the present line is "0" ("1" when the display panel 12 is normally black). When the grayscale data determination section $\mathbf{120}_L$ has determined that the common electrode voltage VCOM in the preceding line is the high-potential-side voltage VCOMH and the common electrode voltage VCOM in the present line is the low-potential-side voltage VCOML, the charge recycle control section $\mathbf{100}_L$ controls the source output switch circuit $SSW_L$ so that the source output switch circuit $SSW_L$ does not short-circuit the source line $S_L$ and the common line COL and does not recycle charges on condition that the MSB data of the grayscale data in the present line is "1" ("0" when the display panel 12 is normally black).

Whether the common electrode voltage VCOM has changed from the high-potential-side voltage VCOMH to the low-potential-side voltage VCOML or changed from the low-potential-side voltage VCOML to the high-potential-side voltage VCOMH across the preceding line and the present line can be determined by detecting the change timing of the polarity inversion signal POL.

The grayscale voltage generation circuit 27 generates 64 grayscale voltages corresponding to the grayscale data. Therefore, determining whether the MSB of the grayscale data is "0" or "1" means determining whether the grayscale voltage corresponding to the 6-bit grayscale data is higher or lower in potential than the intermediate voltage between the highest voltage $V_H$ of grayscale voltage (e.g. voltage corresponding to 6-bit grayscale data "111111") and the lowest voltage $V_L$ (e.g. voltage corresponding to 6-bit grayscale data "000000").

Figure 15A:
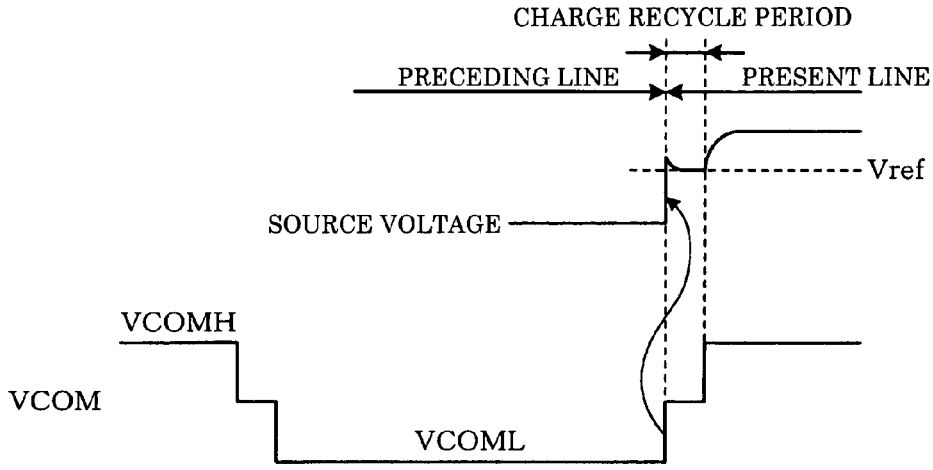
FIGS. 15A and 15B are views illustrative of the effects of charge recycle control according to one embodiment of the invention when performing line inversion drive.
Figure 15B:
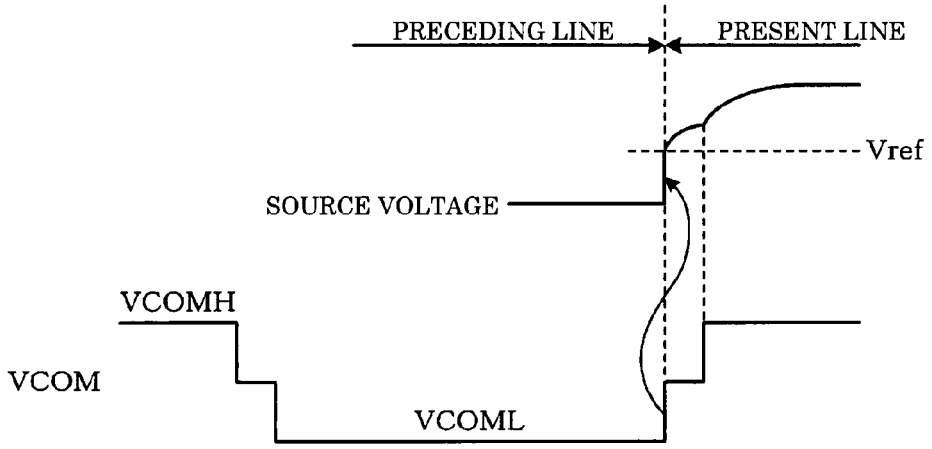

FIGS. 15A and 15B are views illustrative of the effects of the charge recycle control according to this embodiment when performing line inversion drive. FIGS. 15A and 15B show effects achieved when the common electrode voltage VCOM in the preceding line is the low-potential-side voltage VCOML, the common electrode voltage VCOM in the present line is the high-potential-side voltage VCOMH, and the MSB data of the grayscale data in the present line has been determined to be "0" in FIG. 14.

The common electrode CE and the source line (pixel electrode) are capacitively coupled. Therefore, when the voltage applied to the common electrode CE has been changed by polarity inversion drive, the change in the potential of the common electrode CE affects the change in the potential of the source line.

For example, charges are recycled when the voltage of the common electrode CE changes from the low-potential-side voltage VCOML to the high-potential-side voltage VCOMH, as shown in FIG. 15A. In this case, the voltage of the source line $S_L$ may exceed the given reference voltage Vref when the common electrode voltage VCOM changes. When the charge recycle control is performed as described above in the charge recycle period in the first half of the present horizontal scan period (present line), the voltage of the source line $S_L$ becomes almost equal to the reference voltage Vref. When the MSB data of the grayscale data in the present line is "0", the grayscale voltage corresponding to the grayscale data becomes higher in potential than the grayscale voltage corresponding to the intermediate grayscale value. Therefore, since the potential of the source line $S_L$ decreases in the charge recycle period, it is necessary to charge the source line $S_L$ in the subsequent drive period until the grayscale voltage is reached. This means that unnecessary charges must be charged/discharged by recycling charges.

In this embodiment, the charge recycle control is not performed in the case shown in FIG. 15A, as shown in FIG. 15B. This allows the drive voltage in the present horizontal scan period to be supplied to the source line $S_L$ when the common electrode voltage VCOM has changed, whereby unnecessary charging/discharging can be omitted so that power consumption can be reduced.

Figure 16A:
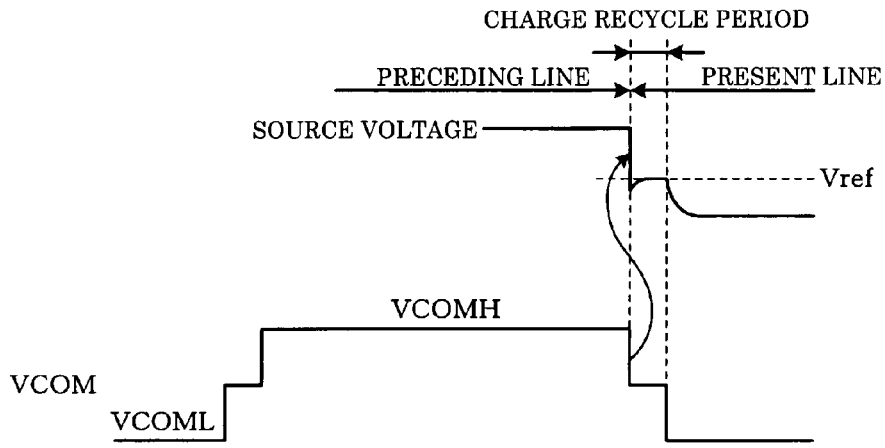
FIGS. 16A and 16B are views illustrative of the effects of charge recycle control according to one embodiment of the invention when performing line inversion drive.
Figure 16B:
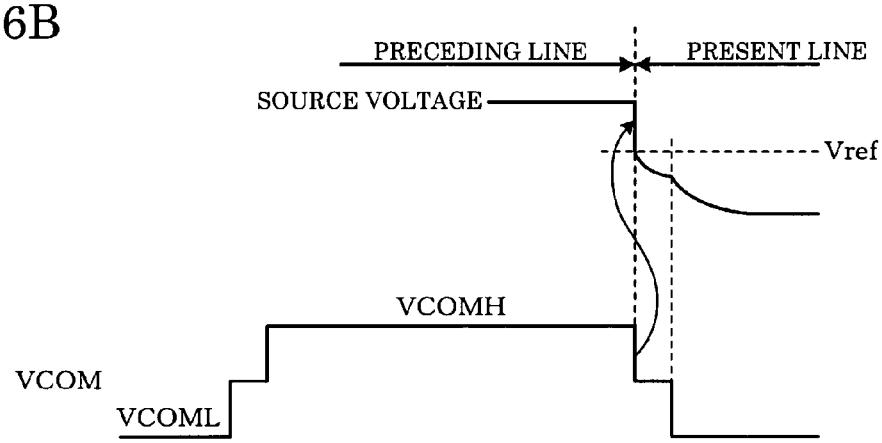

FIGS. 16A and 16B are views illustrative of the effects of the charge recycle control according to this embodiment when performing line inversion drive. FIGS. 16A and 166B show effects achieved when the common electrode voltage VCOM in the preceding line is the high-potential-side voltage VCOMH, the common electrode voltage VCOM in the present line is the low-potential-side voltage VCOML, and the MSB data of the grayscale data in the present line has been determined to be "1" in FIG. 14.

For example, charges are recycled when the voltage of the common electrode CE changes from the high-potential-side voltage VCOMH to the low-potential-side voltage VCOML, as shown in FIG. 16A. In this case, the voltage of the source line $S_L$ may become lower than the given reference voltage Vref when the common electrode voltage VCOM changes. When the charge recycle control is performed as described above in the charge recycle period in the first half of the present horizontal scan period (present line), the voltage of the source line $S_L$ becomes almost equal to the reference voltage Vref. When the MSB data of the grayscale data in the present line is "1", the grayscale voltage corresponding to the grayscale data becomes lower in potential than the grayscale voltage corresponding to the intermediate grayscale value. Therefore, since the potential of the source line $S_L$ increases in the charge recycle period, it is necessary to discharge the source line $S_L$ in the subsequent drive period until the grayscale voltage is reached. This means that unnecessary charges must be charged/discharged by recycling charges.

In this embodiment, as shown in FIG. 16B, the charge recycle control is not performed in the case shown in FIG. 16. This allows the drive voltage in the present horizontal scan period to be supplied to the source line $S_L$ when the common electrode voltage VCOM has changed, whereby unnecessary charging/discharging can be omitted so that power consumption can be reduced.

Figure 17:
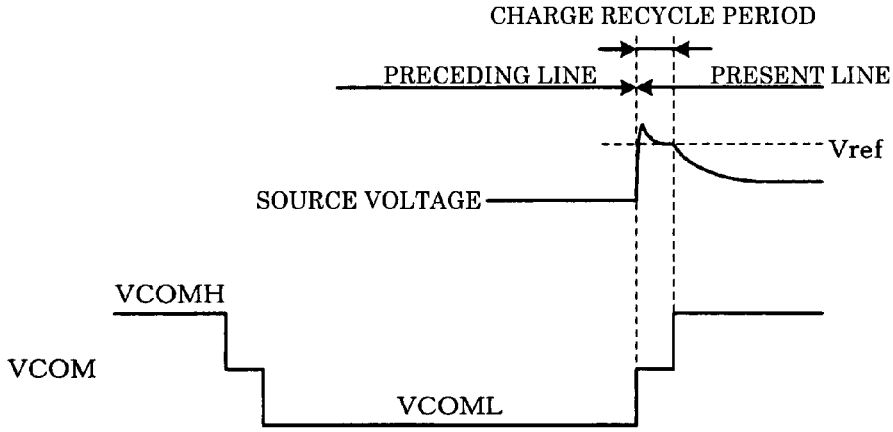
FIG. 17 is a view illustrative of the effects of charge recycle control according to one embodiment of the invention when performing line inversion drive.

FIG. 17 is a view illustrative of the effects of the charge recycle control according to this embodiment when performing line inversion drive. FIG. 17 shows the effects achieved when the common electrode voltage VCOM in the preceding line is the low-potential-side voltage VCOML, the common electrode voltage VCOM in the present line is the high-potential-side voltage VCOMH, and the MSB data of the grayscale data in the present line has been determined to be "1" in FIG. 14.

In this case, the voltage of the source line $S_L$ may exceed the given reference voltage Vref when the voltage of the common electrode CE changes from the low-potential-side voltage VCOML to the high-potential-side voltage VCOMH, as shown in FIG. 17. When the MSB data of the grayscale data in the present line is "1", the grayscale voltage corresponding to the grayscale data becomes lower in potential than the grayscale voltage corresponding to the intermediate grayscale value. Therefore, even if the potential of the source line $S_L$ decreases to the potential of the reference voltage Vref in the charge recycle period, it is necessary to further discharge the source line $S_L$ in the subsequent drive period until the grayscale voltage is reached.

Therefore, the charge recycle control is performed as described above in the case shown in FIG. 17. As a result, it suffices to set the voltage of the source line $S_L$ at the reference voltage Vref by recycling charges without externally charging/discharging the source line $S_L$ when the common electrode voltage VCOM has changed and then supply the drive voltage in the present horizontal scan period to the source line $S_L$, whereby power consumption can be reduced by recycling charges.

Figures 18, 19:
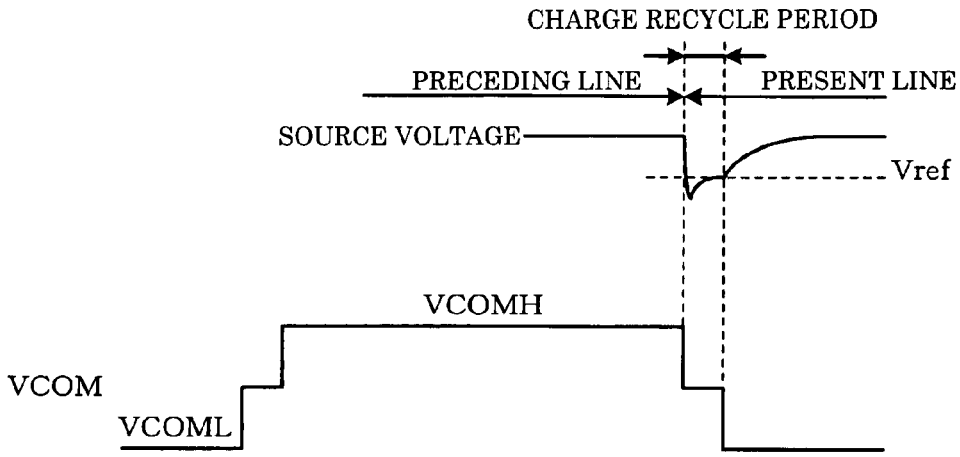
FIG. 18 is a view illustrative of the effects of charge recycle control according to one embodiment of the invention when performing line inversion drive.
FIG. 19 is a view illustrative of a control example of a charge recycle control section shown in FIG. 13 when performing frame inversion drive.

FIG. 18 is a view illustrative of the effects of the charge recycle control according to this embodiment when performing line inversion drive. FIG. 18 shows effects achieved when the common electrode voltage VCOM in the preceding line is the high-potential-side voltage VCOMH, the common electrode voltage VCOM in the present line is the low-potential-side voltage VCOML, and the MSB data of the grayscale data in the present line has been determined to be "0" in FIG. 14.

In this case, the voltage of the source line $S_L$ may become lower than the given reference voltage Vref when the voltage of the common electrode CE changes from the high-potential-side voltage VCOMH to the low-potential-side voltage VCOML, as shown in FIG. 18. When the MSB data of the grayscale data in the present line is "0", the grayscale voltage corresponding to the grayscale data becomes higher in potential than the grayscale voltage corresponding to the intermediate grayscale value. Therefore, even if the potential of the source line $S_L$ increases to the potential of the reference voltage Vref in the charge recycle period, it is necessary to further charge the source line $S_L$ in the subsequent drive period until the grayscale voltage is reached.

Therefore, the charge recycle control is performed as described above in the case shown in FIG. 18. As a result, it suffices to set the voltage of the source line $S_L$ at the reference voltage Vref by recycling charges without externally charging/discharging the source line $S_L$ when the common electrode voltage VCOM has changed and then supply the drive voltage in the present horizontal scan period to the source line $S_L$, whereby power consumption can be reduced by recycling charges.

FIGS. 14 to 18 illustrate the case where the display panel 12 is normally white. Note that the above description also applies to the case where the display panel 12 is normally black. In this case, the MSB data of the grayscale data is reversed.

2.2.2 Frame Inversion Drive

FIG. 19 is a view illustrative of a control example of the charge recycling control section $\mathbf{100}_L$ shown in FIG. 13 when performing frame inversion drive.

When the grayscale data determination section $\mathbf{120}_L$ has determined that the MSB data of the grayscale data in the preceding line is "0" and the MSB data of the grayscale data in the present line is "0", the charge recycling control section $\mathbf{100}_L$ controls the source output switch circuit $SSW_L$ so that the source output switch circuit $SSW_L$ does not short-circuit the source line $S_L$ and the common line COL and does not recycle charges.

When the grayscale data determination section $\mathbf{120}_L$ has determined that the MSB data of the grayscale data in the preceding line is "0" and the MSB data of the grayscale data in the present line is "1", the charge recycling control section $\mathbf{100}_L$ controls the source output switch circuit $SSW_L$ so that the source output switch circuit $SSW_L$ short-circuits the source line $S_L$ and the common line COL to recycle charges.

When the grayscale data determination section $\mathbf{120}_L$ has determined that the MSB data of the grayscale data in the preceding line is "1" and the MSB data of the grayscale data in the present line is "0", the charge recycling control section $\mathbf{100}_L$ controls the source output switch circuit $SSW_L$ so that the source output switch circuit $SSW_L$ short-circuits the source line $S_L$ and the common line COL to recycle charges.

When the grayscale data determination section $\mathbf{120}_L$ has determined that the MSB data of the grayscale data in the preceding line is "1" and the MSB data of the grayscale data in the present line is "1", the charge recycling control section $\mathbf{100}_L$ controls the source output switch circuit $SSW_L$ so that the source output switch circuit $SSW_L$ does not short-circuit the source line $S_L$ and the common line COL and does not recycle charges.

The grayscale voltage generation circuit 27 generates 64 grayscale voltages corresponding to the grayscale data. Therefore, determining whether the MSB of the grayscale data is "0" or "1" means determining whether the grayscale voltage corresponding to the 6-bit grayscale data is higher or lower in potential than the intermediate voltage between the highest voltage $V_H$ of grayscale voltage (e.g. voltage corresponding to 6-bit grayscale data "111111") and the lowest voltage $V_L$ (e.g. voltage corresponding to 6-bit grayscale data "000000").

Figure 20A:
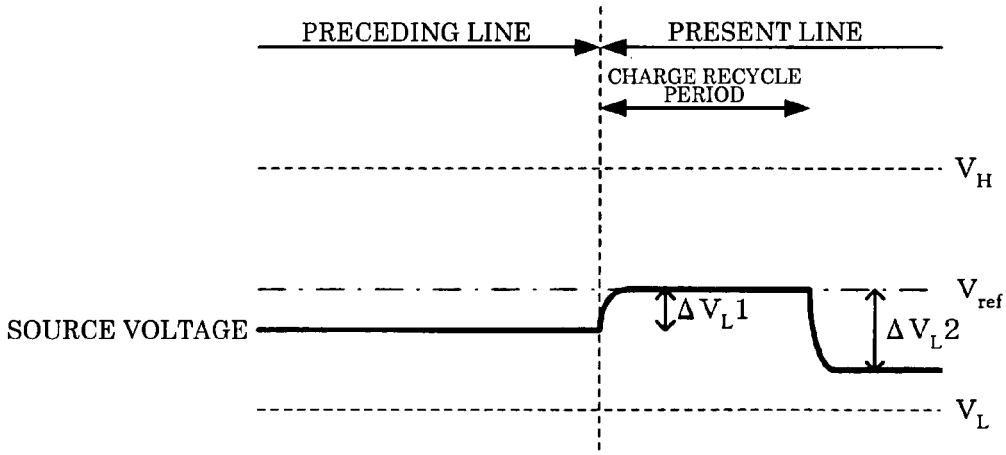
FIGS. 20A and 20B are views illustrative of the effects of charge recycle control according to one embodiment of the invention when performing frame inversion drive.
Figure 20B:
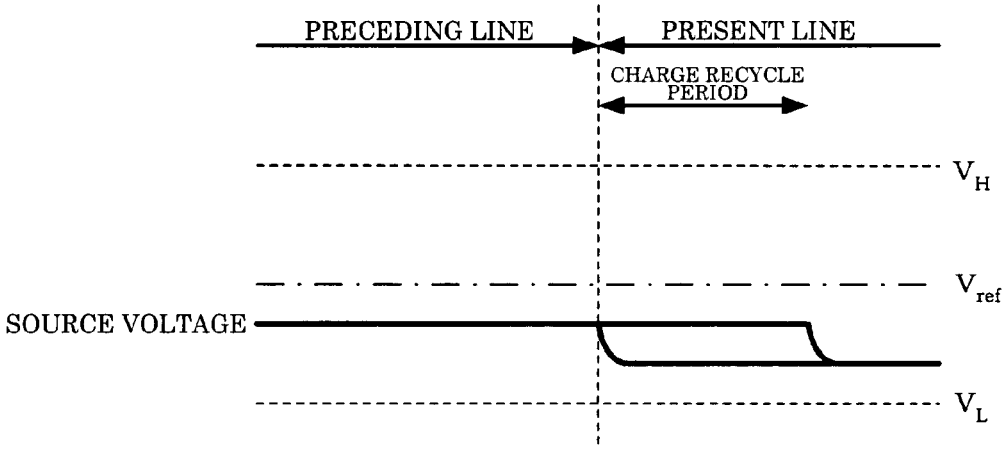

FIGS. 20A and 20B are views illustrative of the effects of the charge recycling control according to this embodiment when performing frame inversion drive. FIGS. 20A and 20B show effects achieved when the MSB data of the grayscale data in the preceding line has been determined to be "0" and the MSB data of the grayscale data in the present line has been determined to be "0" in FIG. 19.

When the MSB data of the grayscale data is "0", the grayscale voltage (voltage driven by the source line driver section) corresponding to the grayscale data is lower in potential than the reference voltage Vref which is the grayscale voltage corresponding to the intermediate grayscale value, as described above. Specifically, the drive voltage of the source line $S_L$ in the preceding horizontal scan period is lower in potential than the reference voltage Vref, and the drive voltage of the source line $S_L$ in the present horizontal scan period is also lower in potential than the reference voltage Vref.

Therefore, when the charge recycle control is performed as described above in the charge recycle period in the first half of the present horizontal scan period, the voltages of the source lines $S_1$, to $S_L$ become almost equal to the reference voltage Vref, as shown in FIG. 20A. Therefore, the source line $S_L$ is externally charged by the amount of charges corresponding to $\Delta V_L\mathbf{1}$ (e.g. positive charges) in the charge recycle period, and discharged by the amount of charges corresponding to $\Delta V_L\mathbf{2}$ in the drive period. This means that the source line $S_L$ is unnecessarily charged/discharged by the amount of charges corresponding to the difference between $\Delta V_L\mathbf{1}$ and $\Delta V_L\mathbf{2}$.

In this embodiment, the charge recycle control is not performed in the case shown in FIG. 20A, as shown in FIG. 20B. This allows the drive voltage in the present horizontal scan period to be supplied to the source line $S_L$ when the horizontal scan period has changed from the preceding horizontal scan period to the horizontal scan period, whereby unnecessary charging/discharging can be omitted so that power consumption can be reduced.

Figure 21A:
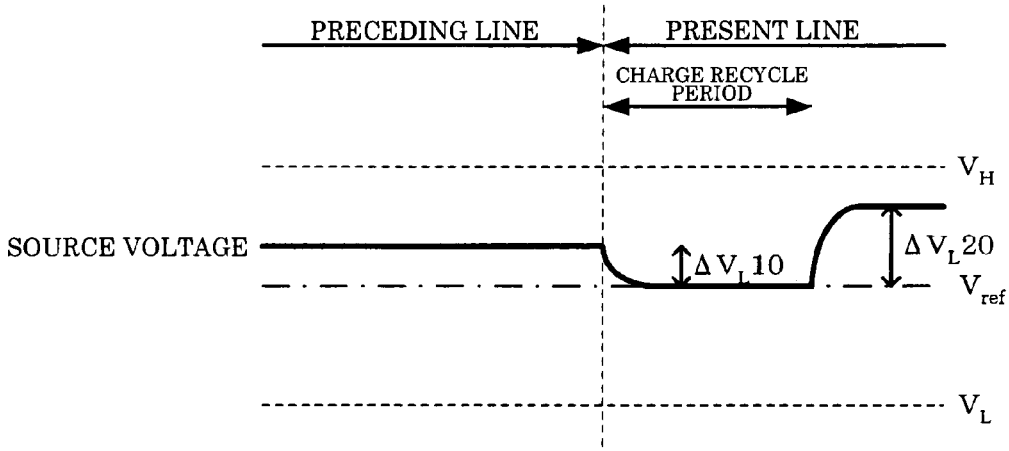
FIGS. 21A and 21B are views illustrative of the effects of charge recycle control according to one embodiment of the invention when performing frame inversion drive.
Figure 21B:
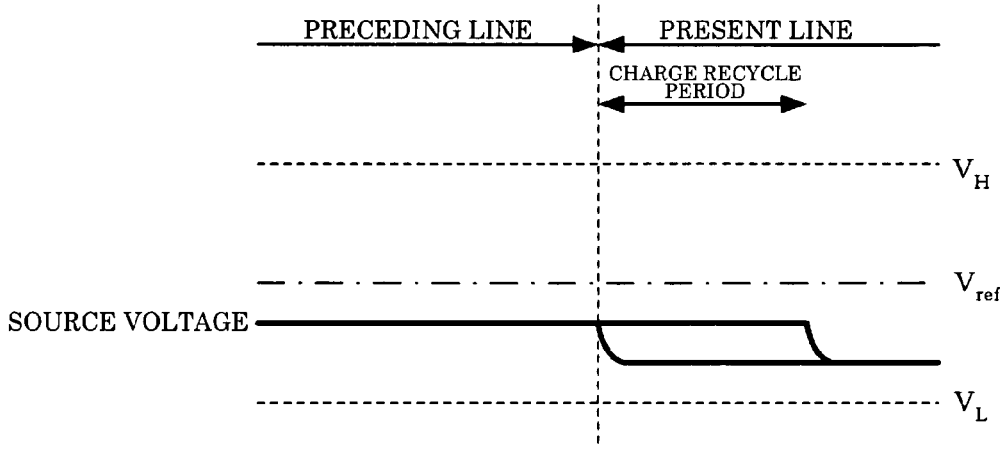

FIGS. 21A and 21B are views illustrative of the effects of the charge recycling control according to this embodiment when performing frame inversion drive. FIGS. 21A and 21B show the effects achieved when the MSB data of the grayscale data in the preceding line has been determined to be "1" and the MSB data of the grayscale data in the present line has been determined to be "1" in FIG. 19.

When the MSB data of the grayscale data is "1", the grayscale voltage (voltage driven by the source line driver section) corresponding to the grayscale data is higher in potential than the reference voltage Vref which is the grayscale voltage corresponding to the intermediate grayscale value, as described above. Specifically, the drive voltage of the source line $S_L$ in the preceding horizontal scan period is higher in potential than the reference voltage Vref, and the drive voltage of the source line $S_L$ in the present horizontal scan period is also higher in potential than the reference voltage Vref.

Therefore, when the charge recycle control is performed as described above in the charge recycle period in the first half of the present horizontal scan period, the voltages of the source lines $S_1$ to $S_L$ become almost equal to the reference voltage Vref, as shown in FIG. 21A. Therefore, the source line $S_L$ is externally discharged by the amount of charges corresponding to $\Delta V_L$10 (e.g. positive charges) in the charge recycle period, and charged by the amount of charges corresponding to $\Delta V_L$20 in the drive period. This means that the source line $S_L$ is unnecessarily charged/discharged by the amount of charges corresponding to the difference between $\Delta V_L$10 and $\Delta V_L$20.

In this embodiment, as shown in FIG. 21 B, the charge recycle control is not performed in the case shown in FIG. 21A. This allows the drive voltage in the present horizontal scan period to be supplied to the source line $S_L$ when the horizontal scan period has changed from the preceding horizontal scan period to the horizontal scan period, whereby unnecessary charging/discharging can be omitted so that power consumption can be reduced.

Figure 22:
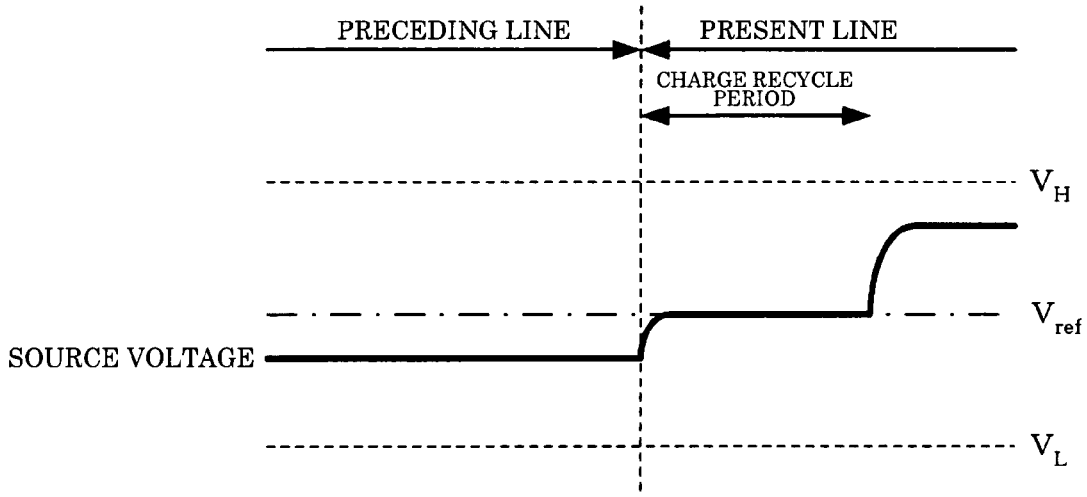
FIG. 22 is a view illustrative of the effects of charge recycle control according to one embodiment of the invention when performing frame inversion drive.

FIG. 22 is a view illustrative of the effects of the charge recycle control according to this embodiment. FIG. 22 shows effects achieved when the MSB data of the grayscale data in the preceding line has been determined to be "0" and the MSB data of the grayscale data in the present line has been determined to be "1" in FIG. 19.

Specifically, the drive voltage of the source line $S_L$ in the preceding horizontal scan period is lower in potential than the reference voltage Vref, and the drive voltage of the source line $S_L$ in the present horizontal scan period is higher in potential than the reference voltage Vref.

Therefore, the charge recycle control is performed as described above in the case shown in FIG. 22. As a result, it suffices to set the voltage of the source line $S_L$ at the reference voltage Vref by recycling charges without externally charging/discharging the source line $S_L$ when the horizontal scan period has changed from the preceding horizontal scan period to the present horizontal scan period and then supply the drive voltage in the present horizontal scan period to the source line $S_L$, whereby power consumption can be reduced by recycling charges.

Figure 23:
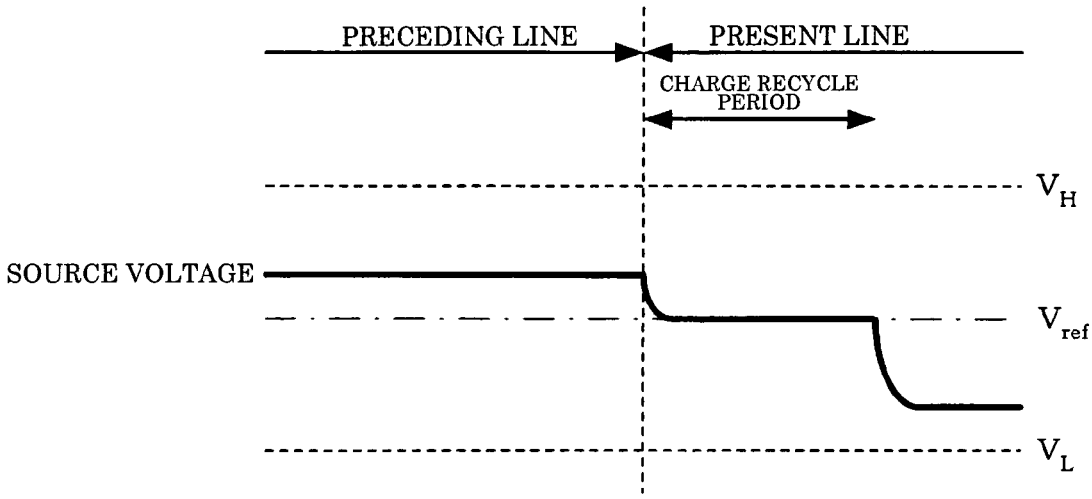
FIG. 23 is a view illustrative of the effects of charge recycle control according to one embodiment of the invention when performing frame inversion drive.

FIG. 23 is a view illustrative of the effects of the charge recycle control according to this embodiment. FIG. 23 shows the effects achieved when the MSB data of the grayscale data in the preceding line has been determined to be "1" and the MSB data of the grayscale data in the present line has been determined to be "0" in FIG. 19.

Specifically, the drive voltage of the source line $S_L$ in the preceding horizontal scan period is higher in potential than the reference voltage Vref, and the drive voltage of the source line $S_L$ in the present horizontal scan period is lower in potential than the reference voltage Vref.

Therefore, the charge recycle control is performed as described above in the case shown in FIG. 23. As a result, it suffices to set the voltage of the source line $S_L$ at the reference voltage Vref by recycling charges without externally charging/discharging the source line $S_L$ when the horizontal scan period has changed from the preceding horizontal scan period to the present horizontal scan period and then supply the drive voltage in the present horizontal scan period to the source line $S_L$, whereby power consumption can be reduced by recycling charges.

2.3 Specific Configuration Example

A specific configuration example for recycling charges is described below.

2.3.1 Source Line Charge Recycle

Figure 24:
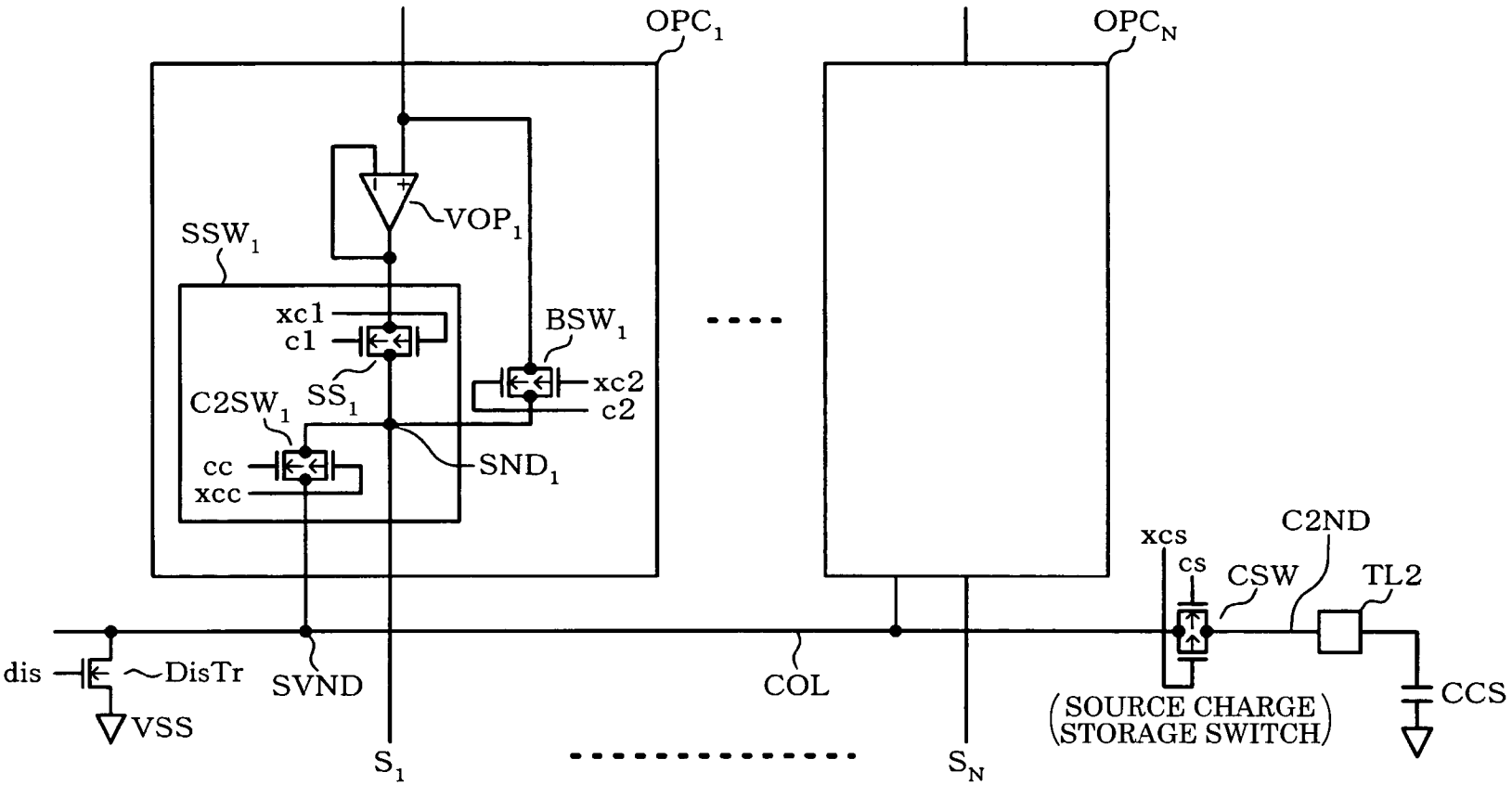
FIG. 24 is a view showing a configuration example of an operational amplifier circuit block and a common line shown in FIG. 8.

FIG. 24 shows a configuration example of the operational amplifier circuit block and the common line COL shown in FIG. 3.

Each of the operational amplifier circuit blocks $OPC_1$ to $OPC_N$ has the same configuration. The following description focuses on the operational amplifier circuit block $OPC_1$.

The operational amplifier circuit block $OPC_1$ includes a voltage-follower-connected operational amplifier $VOP_1$ and the source output switch circuit $SSW_1$. The source output switch circuit $SSW_1$ includes a first source output switch $SS_1$ and a first source short circuit switch C2$SW_1$. The first source output switch $SS_1$ is ON/OFF-controlled using control signals c1 and xc1. The control signal xc1 is an inversion signal of the control signal c1. The first source short circuit switch C2$SW_1$ is ON/OFF-controlled using control signals cc and xcc. The control signal xcc is an inversion signal of the control signal cc. The output of the operational amplifier $VOP_1$ is connected with the first source output node $SND_1$ through the first source output switch $SS_1$. The first source output node $SND_1$ is connected with a given source voltage output node SVND through the first source short circuit switch C2$SW_1$. The source voltage output node SVND is connected with a second capacitor element connection node C2ND through the source charge storage switch CSW. The source charge storage switch CSW is ON/OFF-controlled using control signals cs and xcs. The control signal xcs is an inversion signal of the control signal cs.

The first source short circuit switch C2$SW_1$ is provided between the source voltage output node SVND and the first source output node $SND_1$. The source charge storage switch CSW is provided between the source voltage output node SVND and the second capacitor element connection node C2ND connected with one end of the second capacitor element CCS. The first source output node $SND_1$ and the second capacitor element connection node C2ND are electrically connected through the first source short circuit switch C2$SW_1$ and the source charge storage switch CSW. A voltage corresponding to the grayscale data is supplied to the first source output node $SND_1$ in a state in which the first source output node $SND_1$ and the second capacitor element connection node C2ND are electrically disconnected through the first source short circuit switch C2$SW_1$ and the source charge storage switch CSW.

Specifically, the first source output node $SND_1$, the source voltage output node SVND, and the second capacitor element connection node C2ND are electrically connected through the first source short circuit switch C2$SW_1$ and the source charge storage switch CSW in a state in which the output of the operational amplifier $VOP_1$ (source line driver circuit) is set in a high impedance state by the first source output switch $SS_1$. The operational amplifier $VOP_1$ then supplies a voltage corresponding to the grayscale data to the first source output node $SND_1$ (source line $S_1$) through the first source output switch $SS_1$ in a state in which the first source output node $SND_1$ and the second capacitor element connection node C2ND are electrically disconnected through the first source short circuit switch $C2SW_1$ and the source charge storage switch CSW.

The common line COL including the source voltage output node SVND is similarly connected with the source short circuit switch of each operational amplifier circuit block.

Specifically, the display driver 60 may include the common line COL which is electrically connected with the source voltage output node SVND and of which one end is electrically connected with the source charge storage switch CSW, and a second source short circuit switch $C2SW_2$ provided between a second source output node $SND_2$ to which the voltage output to the second source line $S_2$ is supplied and the common line COL. The first source short circuit switch $C2SW_1$ is provided between the first source output node $SND_1$ and the common line COL. The second source short circuit switch $C2SW_2$ is provided between the second source output node $SND_2$ and the common line COL.

The display driver 60 may include a discharge transistor DisTr. A control signal dis is supplied to the gate of the discharge transistor DisTr. A discharge voltage (e.g. system ground power supply voltage VSS) is supplied to the source of the discharge transistor DisTr, and the drain of the discharge transistor DisTr is electrically connected with the common line COL. The voltage of the common line COL is set at the discharge voltage using the control signal dis. The discharge transistor DisTr is used in common to discharge the first and second source lines.

In the select period of the pixel electrode of the display panel 12, the first and second source lines $S_1$ and $S_2$ can be discharged by turning ON the discharge transistor DisTr in a state in which the first and second source short circuit switches $C2SW_1$ and $C2SW_2$ are set in a conducting state. This makes it possible to achieve an OFF-write operation using an extremely simple configuration. The term "OFF-write operation" means applying a given OFF voltage to the source line in order to transition to a display OFF state.

The operational amplifier circuit block $OPC_1$ may also include a first bypass switch $BSW_1$. The first bypass switch $BSW_1$ is ON/OFF controlled using control signals c2 and xc2. The control signal xc2 is an inversion signal of the control signal c2. In the operational amplifier circuit block $OPC_1$, charges are recycled as described above in the first period of one horizontal scan period as the select period of the pixel, and the source line $S_1$ is drive-controlled using the first source output switch $SS_1$ and the first bypass switch $BSW_1$ in the drive period in the second period of the horizontal scan period.

Specifically, the first source output node $SND_1$ is driven by the operational amplifier $VOP_1$ in the first period of the drive period in a state in which the first source output switch $SS_1$ is set in a conducting state and the first bypass switch $BSW_1$ is set in a nonconducting state. In the second period of the drive period, the input voltage of the operational amplifier $VOP_1$ is supplied to the first source output node $SND_1$ in a state in which the first source output switch $SS_1$ is set in a nonconducting state and the first bypass switch $BSW_1$ is set in a conducting state. This allows the voltage applied to the first source output node $SND_1$ to be set at a high speed with high accuracy.

Figure 25:
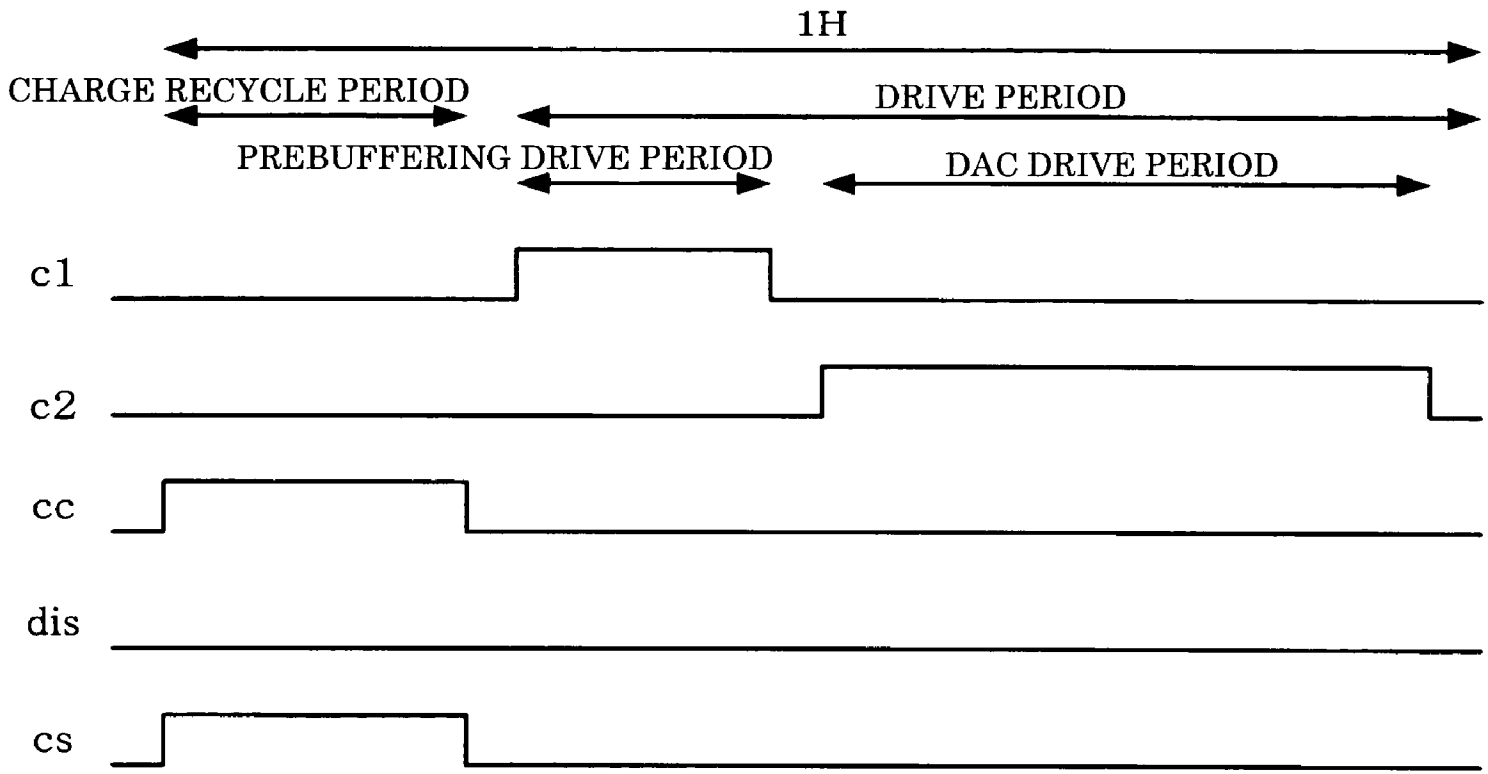
FIG. 25 is a timing diagram showing a control example of the operational amplifier circuit block shown in FIG. 24.

FIG. 25 is a timing diagram of a control example of the operational amplifier circuit block $OPC_1$ shown in FIG. 24.

In FIG. 25, each switch is turned ON (conducting state) when the control signals c1, c2, cc, cs, and dis shown in FIG. 24 are set at the H level. In the example shown in FIG. 25, the control signal dis is always set at the L level. FIG. 25 illustrates only the control example of the operational amplifier circuit block $OPC_1$. Note that the operational amplifier circuit blocks $OPC_2$ to $OPC_N$ are controlled using the same control signals as the operational amplifier circuit block $OPC_1$.

In the charge recycle period in the first period of one horizontal scan period, the control signals cc and cs are set at the H level, and the control signals c1 and c2 are set at the L level. This causes the source charge storage switch CSW to be set in a conducting state. The first source output node $SND_1$ and one end of the second capacitor element CCS connected with the second capacitor element connection terminal TL2 are set at the same potential. This allows charges stored in the second capacitor element CCS to be recycled, whereby the potential of the first source output node $SND_1$ is changed.

In the prebuffering drive period in the drive period, the control signals cc and cs are set at the L level, and the control signal c1 is set at the H level. The source charge storage switch CSW is turned OFF (nonconducting state) in the drive period. This allows the first source output node $SND_1$ of which the potential has changed in the charge recycle period to be driven by the operational amplifier $VOP_1$. The data voltage selected by the DAC 28 is supplied to the operational amplifier $VOP_1$. Although the operational amplifier $VOP_1$ consumes an operating current, the operational amplifier $VOP_1$ can change the potential of the first source output node $SND_1$ at a high speed with a high drive capability.

In the DAC drive period in the drive period, the control signal c1 is set at the L level, and the control signal c2 is set at the H level. Therefore, the first source output node $SND_1$ is electrically disconnected from the output of the operational amplifier $VOP_1$, and the data voltage from the DAC 28 is directly supplied to the first source output node $SND_1$. This allows the first source output node $SND_1$ to be set at the accurate data voltage from the DAC 28. Since the operation of the operational amplifier $VOP_1$ can be suspended in the DAC drive period, power consumption can be reduced.

Whether or not to recycle charges can be independently controlled in source output units, as described above, by generating the control signals cc, xcc, c1, xc1, c2, and xc2 in units of the operational amplifier circuit blocks.

Figure 26:
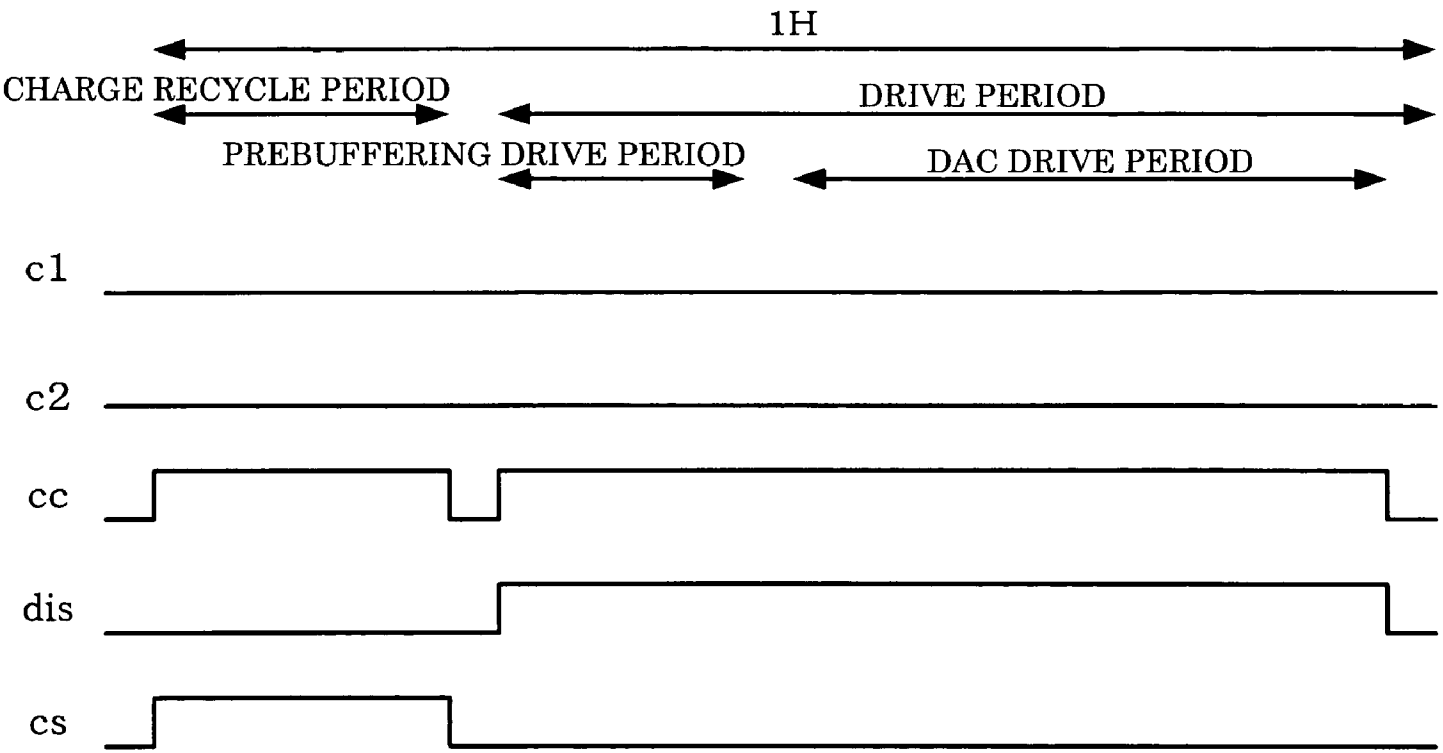
FIG. 26 is a timing diagram of another control example of the operational amplifier circuit block shown in FIG. 24.

FIG. 26 is a timing diagram of another control example of the operational amplifier circuit block $OPC_1$ shown in FIG. 24.

FIG. 26 is a timing diagram of a control example of the OFF-write operation. Control in the charge recycle period and switch control of the source charge storage switch CSW are the same as in FIG. 25.

In the prebuffering period and the DAC drive period in the drive period, the control signal cc is set at the H level, and the control signal dis is set at the H level. This allows the common line COL to be set at the system ground power supply voltage VSS through the discharge transistor DisTr. This first source output node $SND_1$ of which the potential has changed in the charge recycle period is set at the system ground power supply voltage VSS through the first source short circuit switch $C2SW_1$ set in a conducting state. The voltage of the first source output node $SND_1$ is supplied to the first source line $S_1$, whereby the OFF-write control operation is achieved. Therefore, it suffices to write the voltage of the first source output node SND1 supplied to the source line into the pixel electrode of the display panel 12 in the same manner as in the normal display operation.

The above OFF-write control operation is similarly performed in the operational amplifier circuit blocks $OPC_2$ to $OPC_N$. This makes it possible to perform the display OFF control operation using an extremely simple configuration without causing the DAC to supply a specific OFF voltage.

2.3.2 Common Electrode Charge Recycle

Figure 27:
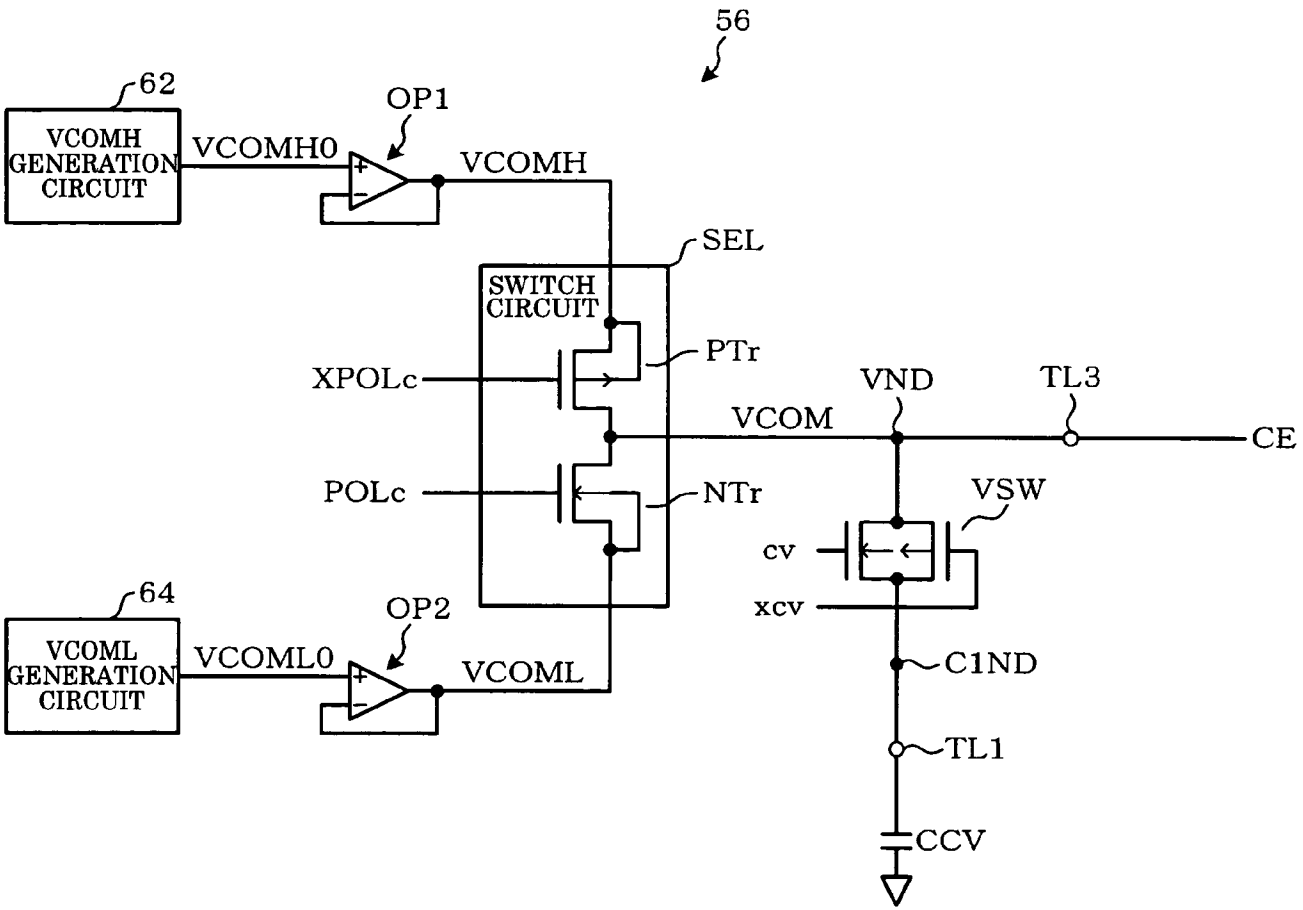
FIG. 27 is a view showing a configuration example of a common electrode voltage generation circuit shown in FIG. 6.

FIG. 27 is a view showing a configuration example of the common electrode voltage generation circuit 56 shown in FIG. 6.

The common electrode voltage generation circuit 56 generates the common electrode voltage VCOM applied to the common electrode CE opposite to the pixel electrode of the display panel 12 (electro-optical device) through the liquid crystal element (electro-optical material). The common electrode voltage generation circuit 56 includes first and second operational amplifiers OP1 and OP2 which are voltage-follower-connected operational amplifiers, and a switch circuit SEL. The first operational amplifier OP1 outputs the high-potential-side voltage VCOMH of the common electrode voltage VCOM. The second operational amplifier OP2 outputs the low-potential-side voltage VCOML of the common electrode voltage VCOM. The switch circuit SEL outputs one of the high-potential-side voltage VCOMH and the low-potential-side voltage VCOML as the common electrode voltage VCOM at the polarity inversion timing at which the polarity of the voltage applied to the liquid crystal element (electro-optical material) is reversed. The first and second operational amplifiers OP1 and OP2 may operate as regulators.

The switch circuit SEL may include a P-type (first conductivity type) metal-oxide-semiconductor (MOS) transistor (hereinafter simply called "transistor") Otr and an N-type (second conductivity type) transistor NTr. The source of the transistor PTr is connected with the output of the first operational amplifier OP1. The drain of the transistor PTr is electrically connected with the common electrode CE. A control signal XPOLc is supplied to the gate of the transistor PTr. The source of the transistor NTr is connected with the output of the second operational amplifier OP2. The drain of the transistor NTr is electrically connected with the common electrode CE. A control signal POLc is supplied to the gate of the transistor NTr.

The control signals XPOLc and POLc are generated based on the polarity inversion signal POL specifying the polarity inversion timing. The switch circuit SEL outputs the high-potential-side voltage VCOMH or the low-potential-side voltage VCOML based on the control signals XPOLc and POLc. The switch circuit SEL sets the output in a high impedance state based on the control signals XPOLc and POLc.

The common electrode voltage generation circuit 56 may include a VCOMH generation circuit (common electrode high-potential-side voltage generation circuit) 62 and a VCOML generation circuit (common electrode low-potential-side voltage generation circuit) 64. The VCOMH generation circuit 62 can generate a voltage VCOMH0 by a charge-pump operation based on the system ground power supply voltage VSS and the power supply voltage VDDHS, for example. The voltage VCOMH0 is supplied to the input of the first operational amplifier OP1. The VCOML generation circuit 64 can generate a voltage VCOML0 by a charge-pump operation based on the system ground power supply voltage VSS and the power supply voltage VDDHS, for example. The voltage VCOML0 is supplied to the input of the second operational amplifier OP2.

When the common electrode voltage generation circuit 56 outputs the high-potential-side voltage VCOMH as the common electrode voltage VCOM using the switch circuit SEL, the common electrode voltage generation circuit 56 suspends or limits the operating current of the second operational amplifier OP2 using a control signal (not shown). When the common electrode voltage generation circuit 56 outputs the low-potential-side voltage VCOML as the common electrode voltage VCOM using the switch circuit SEL, the common electrode voltage generation circuit 56 suspends or limits the operating current of the first operational amplifier OP1 using a control signal (not shown).

According to this configuration, when applying one of the high-potential-side voltage VCOMH and the low-potential-side voltage VCOML of the common electrode voltage VCOM to the common electrode CE, since the operating current of the operational amplifier which outputs the other of the high-potential-side voltage VCOMH and the low-potential-side voltage VCOML can be suspended or limited, current consumption unnecessary for generating the common electrode voltage VCOM can be reduced.

The output of the switch circuit SEL is electrically connected with the common electrode voltage output node VND. The common electrode voltage output node VND is electrically connected with the first capacitor element connection node C1ND connected with one end of the first capacitor element. The first capacitor element connection node C1ND is electrically connected with the common electrode CE of the display panel 12 through the common electrode voltage output terminal TL3.

The common electrode charge storage switch VSW is provided between the first capacitor element connection node C1ND and the common electrode voltage output node VND through the electro-optical material. The common electrode charge storage switch VSW is ON/OFF controlled using control signals cv and xcv. The control signal xcv is an inversion signal of the control signal cv.

The common electrode voltage output node VND and the first capacitor element connection node C1ND are electrically connected through the common electrode charge storage switch VSW when changing the common electrode voltage VCOM, and the common electrode voltage VCOM is then supplied to the common electrode voltage output node VND. Specifically, the common electrode voltage output node VND and the first capacitor element connection node C1ND are electrically connected through the common electrode charge storage switch VSW in a state in which the output of the common electrode voltage generation circuit 56 (switch circuit SEL) is set in a high impedance state, and the common electrode voltage generation circuit 56 (switch circuit SEL) then supplies the common electrode voltage VCOM to the common electrode CE.

In this embodiment, the grayscale voltage corresponding to the intermediate grayscale value is used as the reference voltage Vref. Note that the reference voltage is not limited thereto. For example, the intermediate voltage ($=(V_H+V_L)/2$) between the highest voltage $V_H$ and the lowest voltage $V_L$ of the grayscale voltage may be ideally used as the reference voltage. The circuit configuration can be simplified by using the above intermediate voltage as the reference voltage Vref.

2.4 Modification

This embodiment has been described above taking an example in which the reference voltage Vref is a fixed voltage which is the grayscale voltage corresponding to the intermediate grayscale value. Note that the reference voltage Vref is not limited thereto. The level of the reference voltage Vref may be changed by holding all of the 6 bits of the grayscale data from the line latch $\mathbf{26}_L$ and comparing the grayscale data with given reference data to determine whether or not the grayscale data is larger than the reference data.

Figure 28:
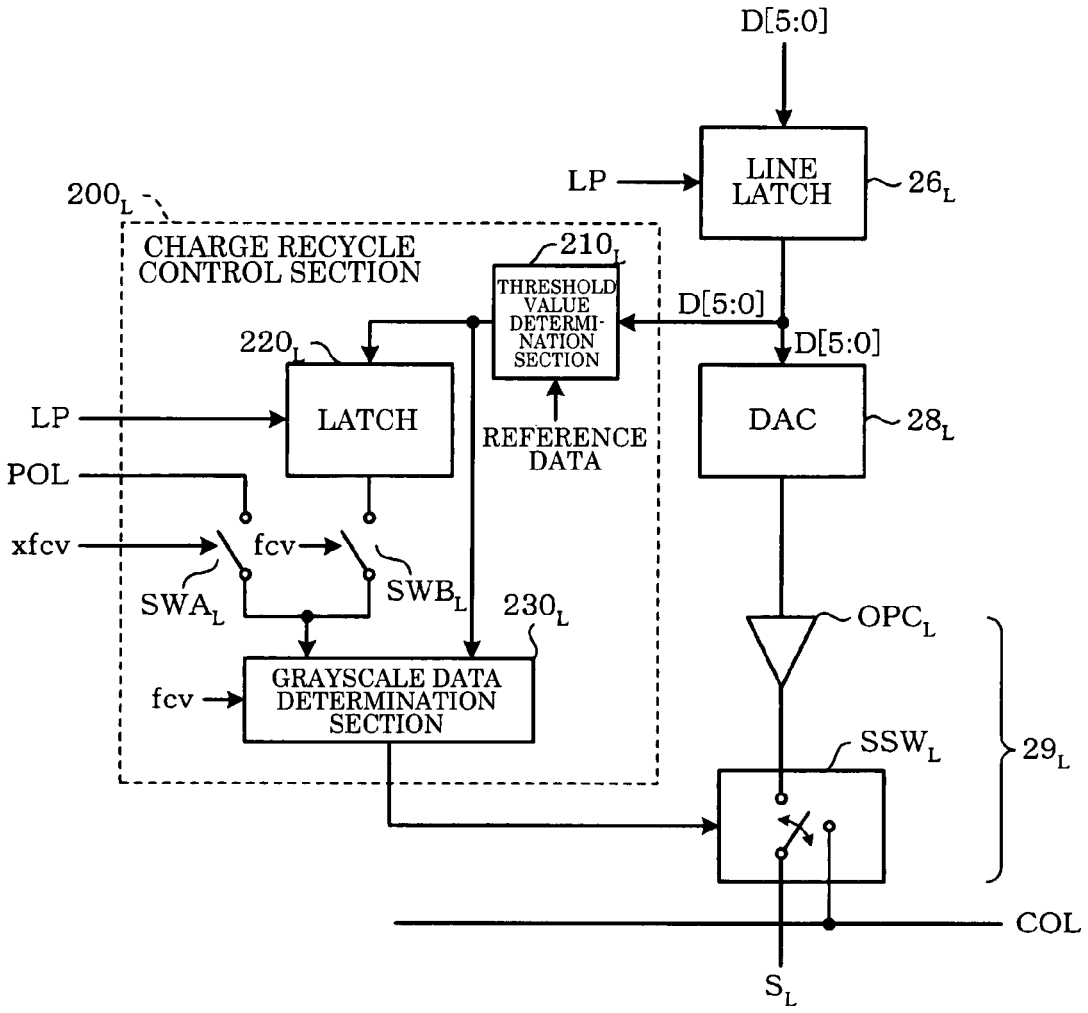
FIG. 28 is a view showing the major portion of the configuration of a source line driver circuit according to a modification of one embodiment of the invention.

FIG. 28 shows the major portion of the configuration of the source line driver circuit 20 according to a modification of this embodiment. FIG. 28 shows the configuration of one output in the same manner as in FIG. 13. In FIG. 28, the same sections as in FIG. 13 are indicated by the same symbols. Description of these sections is appropriately omitted.

In FIG. 28, a charge recycle control section $\mathbf{200}_L$ is provided instead of the charge recycle control section $\mathbf{100}_L$ shown in FIG. 13. The charge recycle control section $\mathbf{200}_L$ includes a threshold value determination section $\mathbf{210}_L$, a latch $\mathbf{220}_L$, and a grayscale data determination section $\mathbf{230}_L$ Reference data is input to the threshold value determination section $\mathbf{210}_L$ as threshold value data. The threshold value determination section $\mathbf{210}_L$ compares the reference data and the grayscale data D[5:0] from the line latch $\mathbf{26}_L$, and outputs the comparison result as a comparison result signal. The latch $\mathbf{220}_L$ latches the comparison result signal from the threshold value determination section $\mathbf{210}_L$ at the change timing of the horizontal synchronization signal LP.

When performing line inversion drive, the grayscale data determination section $\mathbf{230}_L$ determines whether or not to short-circuit the source line $S_L$ and the common line COL as shown in FIG. 14 based on the polarity inversion signal POL and the comparison result signal from the threshold value determination section $\mathbf{210}_L$.

When performing frame inversion drive, the grayscale data determination section $\mathbf{230}_L$ compares the comparison result signal from the threshold value determination section $\mathbf{210}_L$ and the comparison result signal latched by the latch $\mathbf{220}_L$. Specifically, the comparison result signal latched by the latch $\mathbf{220}_L$ is a first comparison result obtained by comparing the first grayscale voltage supplied to the source line in the preceding horizontal scan period and the given reference data. The comparison result signal latched by the threshold value determination section $\mathbf{210}_L$ is a second comparison result obtained by comparing the reference data and the second grayscale data for generating the second grayscale voltage supplied to the source line in the present horizontal scan period.

The source output switch circuit $SSW_L$ is switch-controlled based on the output from the grayscale data determination section $\mathbf{230}_L$.

According to this configuration, the threshold value determination section $\mathbf{210}_L$ can determine whether the grayscale voltage corresponding to the grayscale data D[5:0] is higher or lower in potential than the grayscale voltage corresponding to the reference data by comparing the reference data and the grayscale data D[5:0] and determining whether the grayscale data D[5:0] is larger or smaller than the reference data, for example. The grayscale data determination section $\mathbf{230}_L$ determines whether or not to recycle charges when the common electrode voltage VCOM changes as shown in FIG. 14, or whether or not the grayscale voltages corresponding to the grayscale data D[5:0] are higher or lower than the grayscale voltage corresponding to the reference data in two consecutive horizontal scan periods.

When performing line inversion drive, the charge recycle control section $\mathbf{200}_L$ determines whether the grayscale voltage in the present line is higher or lower in potential than the reference voltage when the common electrode voltage VCOM changes, and the source output switch circuit $SSW_L$ short-circuits the source line $S_L$ and the common line COL based on the determination result. When performing frame inversion drive, the source output switch circuit $SSW_L$ short-circuits the source line $S_L$ and the common line COL when the charge recycle control section $\mathbf{200}_L$ has determined that the grayscale voltages corresponding to the grayscale data D[5:0] are higher or lower in potential than the grayscale voltage corresponding to the reference data in two consecutive horizontal scan periods.

This enables whether the grayscale voltage in the present line is higher or lower in potential than the voltage which can be set between the highest voltage $V_H$ and the lowest voltage $V_L$ to be determined when the common electrode voltage VCOM changes, whereby charges can be recycled or charge recycle can be omitted. Alternatively, whether the grayscale voltages in two consecutive horizontal scan periods are higher or lower in potential than the voltage which can be set between the highest voltage $V_H$ and the lowest voltage $V_L$ can be determined, whereby charges can be recycled or charge recycle can be omitted.

This embodiment has been described above taking an example in which the charge recycle control is performed as described above based on the control data set in the polarity inversion drive mode setting register. Note that this embodiment is not limited thereto.

For example, the logic level of the polarity inversion signal POL in the preceding horizontal scan period (preceding line) may be compared with the logic level of the polarity inversion signal POL in the present horizontal scan period (present line) at the start timing of one horizontal scan period, and the charge recycle control may be performed based on the comparison result. Specifically, when the polarity inversion signal POL in the preceding horizontal scan period is set at the H level and the polarity inversion signal POL in the present horizontal scan period is set at the L level, the charge recycle control during line inversion drive is performed, as shown in FIG. 14. When the polarity inversion signal POL in the preceding horizontal scan period is set at the H level and the polarity inversion signal POL in the present horizontal scan period is set at the H level, the charge recycle control during frame inversion drive is performed, as shown in FIG. 19. This enables the charge recycle control similar to that during line inversion drive to be performed in the first horizontal scan period of one vertical scan period, even if frame inversion drive is performed, for example. This achieves effects similar to those obtained during line inversion drive when focusing on the first horizontal scan period of one vertical scan period and the preceding horizontal scan period.

As described above, unnecessary charging/discharging can be eliminated during n-line inversion drive and interlace inversion drive in addition to line inversion drive and frame inversion drive by combining the control shown in FIG. 14 or 19 irrespective of the polarity inversion driving mode, whereby power consumption can be further reduced.

The display driver 60 which drives the display panel 12 shown in FIG. 1 or 2 has been described in this embodiment. Note that this embodiment is not limited thereto.

Figure 29:
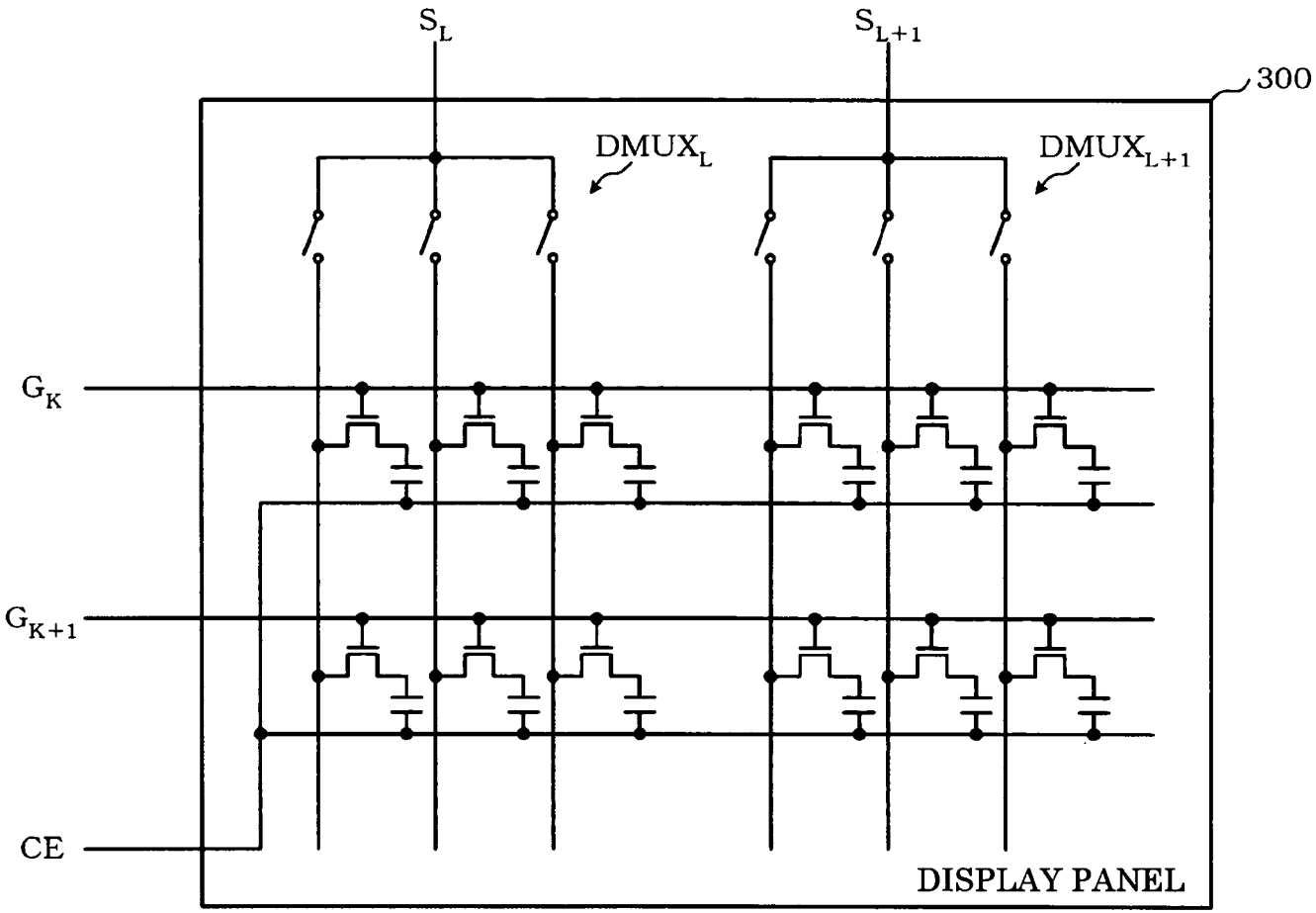
FIG. 29 is a view showing an outline of another configuration example of a display panel.

FIG. 29 shows an outline of another configuration example of the display panel.

In FIG. 29, the same sections as in FIG. 1 or 2 are indicated by the same symbols. Description of these sections is appropriately omitted. A display panel 300 shown in FIG. 29 includes demultiplexers in units of source outputs driven by the display driver. Specifically, the display panel 300 includes a demultiplexer $DMUX_L$ corresponding to the source line $S_L$ and a demultiplexer $DMUX_{L+1}$ corresponding to the source line $S_{L+1}$. The demultiplexer DMUX divides each source output into three color component source lines. In the display panel 300, the source of the TFT is connected with each color component source line. Therefore, when outputting the data voltage corresponding to the grayscale data of three dots to each source output by time division, the demultiplexer DMUX can separate the time-division multiplexed data voltage and output the separated data voltage to each color component source line.

Figure 30:
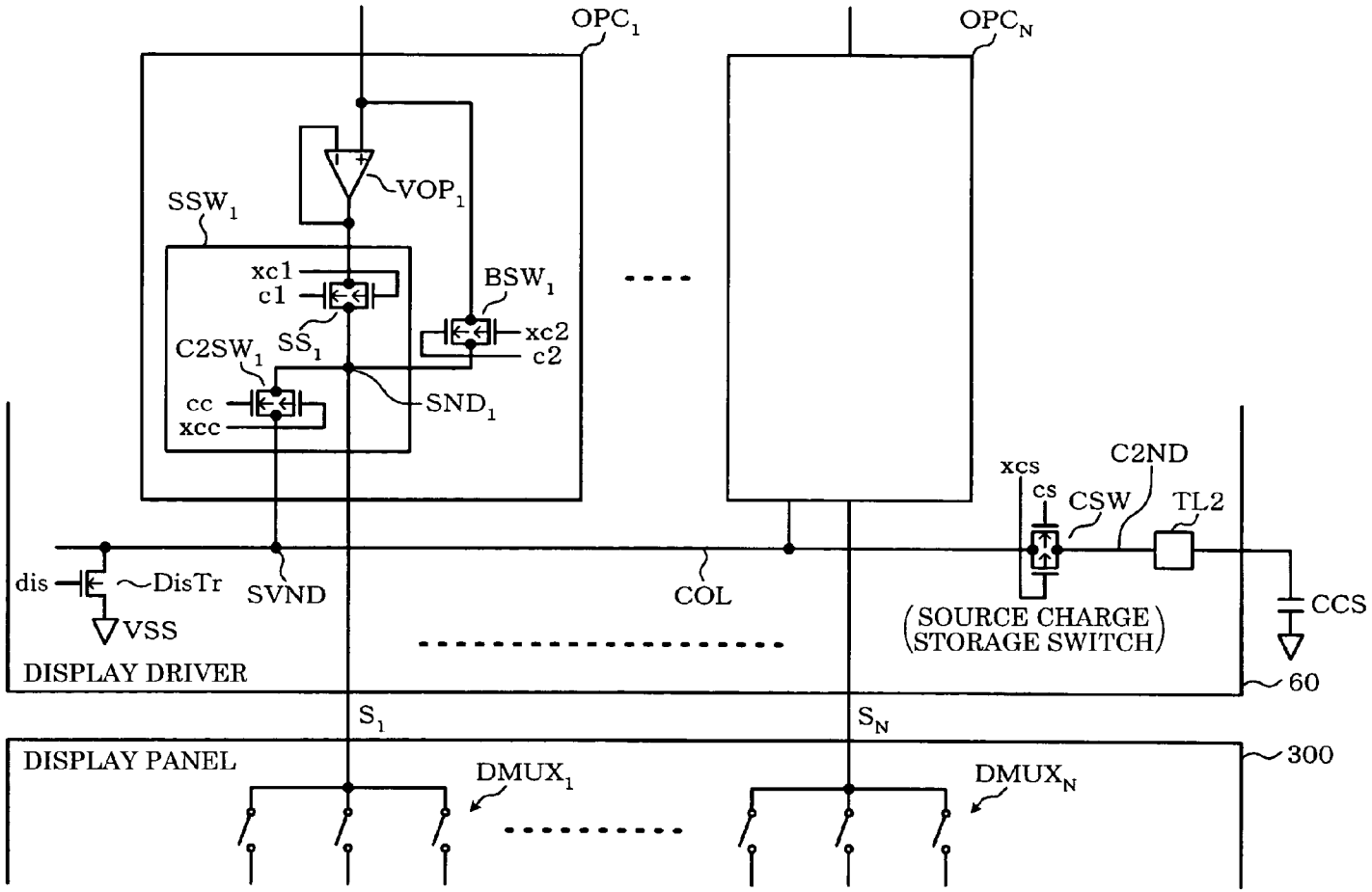
FIG. 30 is a view showing the major portion of the configuration of a display driver which drives the display panel shown in FIG. 29.

FIG. 30 shows the major portion of the configuration of the display driver which drives the display panel shown in FIG. 29.

In FIG. 30, the same sections as in FIG. 24 are indicated by the same symbols. Description of these sections is appropriately omitted. In the display driver shown in FIG. 30, the data voltage of three dots is time-division multiplexed and input to each operational amplifier block. Each of the demultiplexers $DMUX_1$ to $DMUX_N$ can separate each source output by supplying a time-division multiplex timing signal to the display panel 300.

Figure 31:
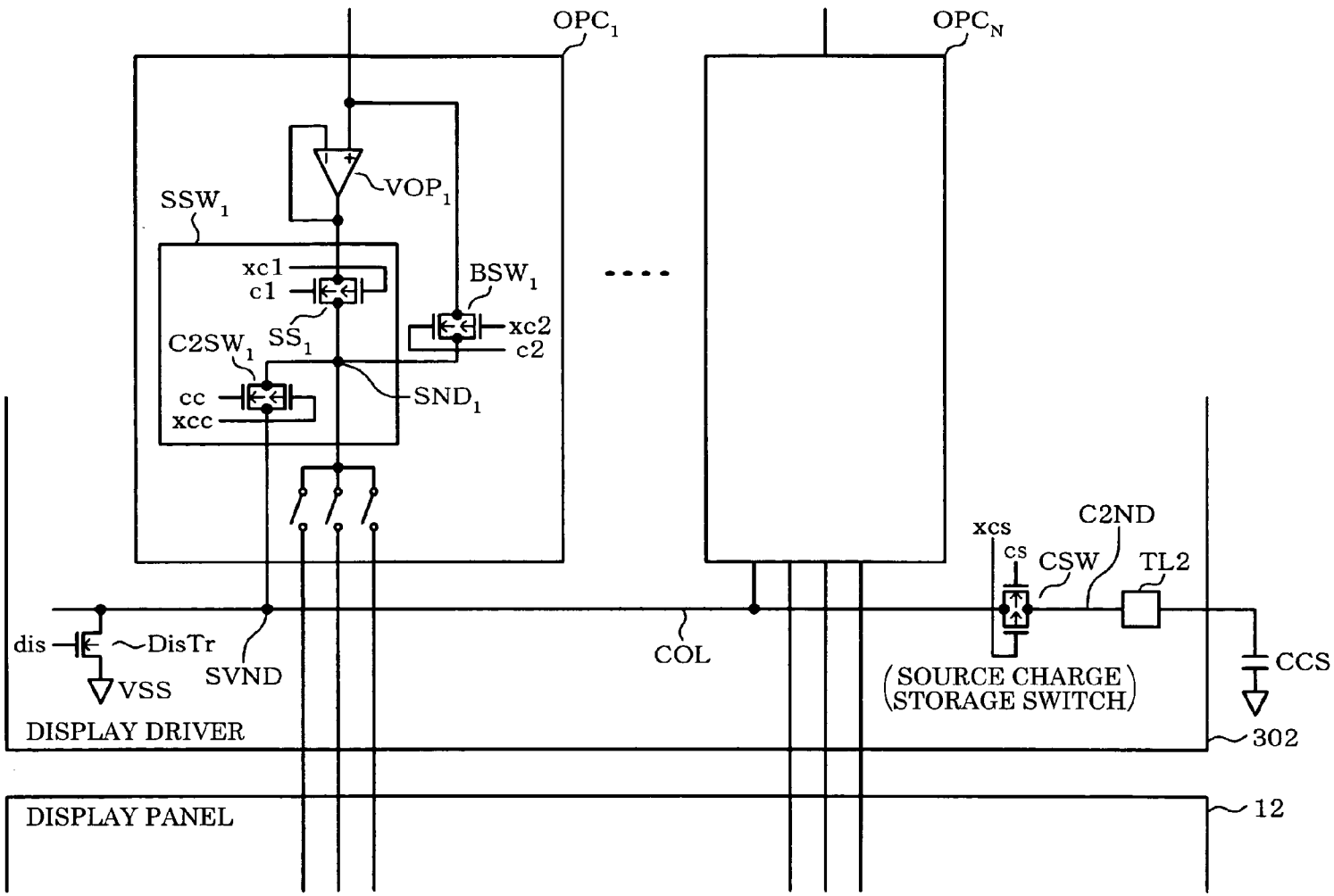
FIG. 31 is another view showing the major portion of the configuration of a display driver which drives the display panel shown in FIG. 29.

The demultiplexers $DMUX_1$ to $DMUX_N$ shown in FIG. 29 may be provided in the display driver, as shown in FIG. 31. Specifically, a display driver 302 includes demultiplexers for separating the time-division multiplexed voltage of each source output node into output voltages, and supplies each output voltage to each source line of the display panel. In this case, since it is unnecessary to supply the time-division multiplex timing signal of the data voltage to the display panel, the mounting area can be reduced.

3. Electronic Instrument

Figure 32:
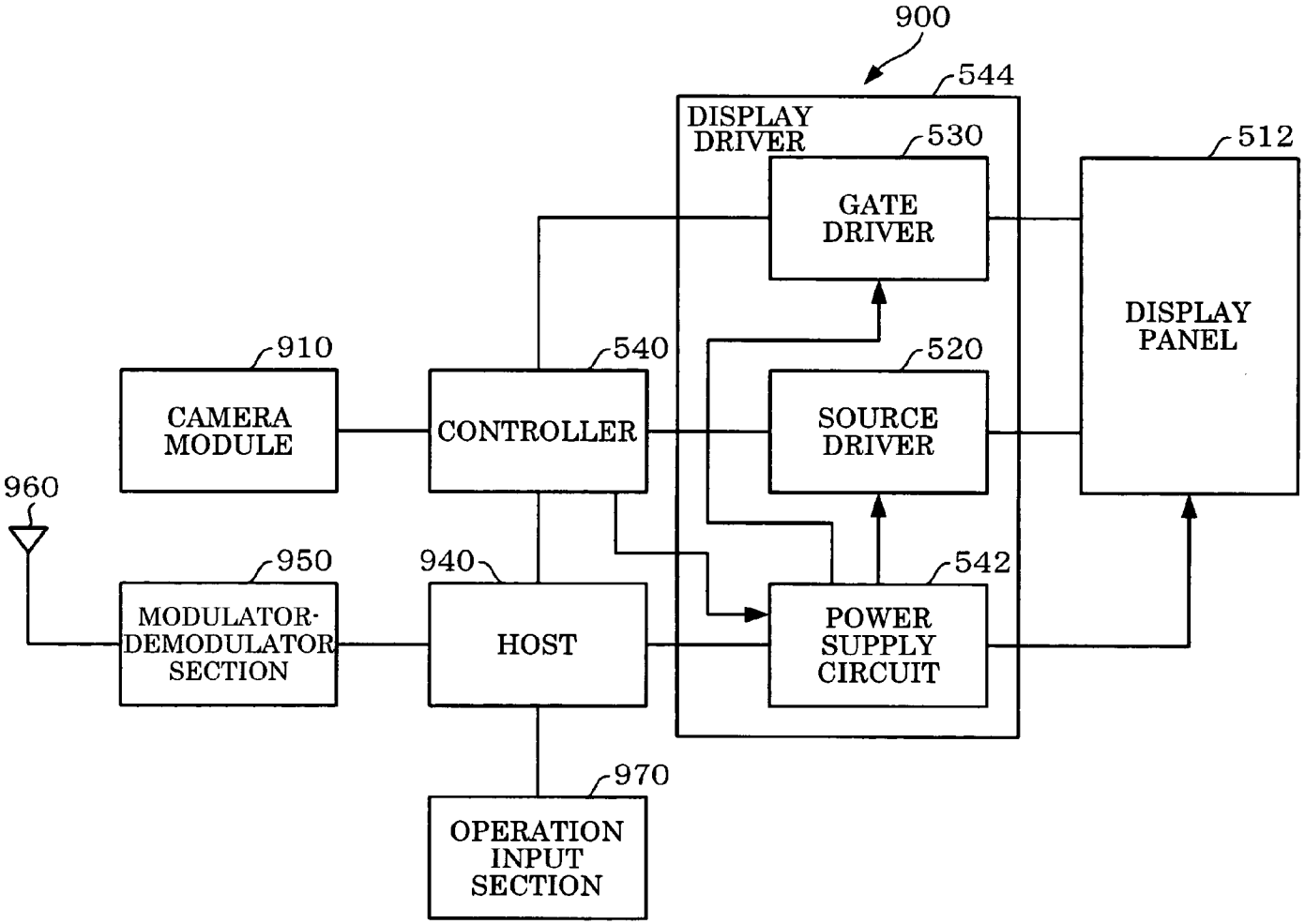
FIG. 32 is a block diagram showing a configuration example of an electronic instrument according to one embodiment of the invention.

FIG. 32 is a block diagram showing a configuration example of an electronic instrument according to this embodiment. FIG. 32 is a block diagram showing a configuration example of a portable telephone as an example of the electronic instrument.

A portable telephone 900 includes a camera module 910. The camera module 910 includes a CCD camera and supplies data of an image captured using the CCD camera to the display controller 540 in a YUV format. The display controller 540 has the functions of the display controller 40 shown in FIG. 1 or 2.

The portable telephone 900 includes a display panel 512. The display panel 512 is driven by a source driver 520 and a gate driver 530. The display panel 512 includes gate lines, source lines, and pixels. The display panel 512 has the functions of the display panel 12 shown in FIG. 1 or 2.

The display controller 540 is connected with the source driver 520 and the gate driver 530, and supplies grayscale data in an RGB format to the source driver 520.

A power supply circuit 542 is connected with the source driver 520 and the gate driver 530, and supplies driving power supply voltages to the source driver 520 and the gate driver 530. The power supply circuit 542 has the function of the power supply circuit 50 shown in FIG. 1 or 2. The portable telephone 900 includes the source driver 520, the gate driver 530, and the power supply circuit 542 as a display driver 544. The display driver 544 drives the display panel 512.

A host 940 is connected with the display controller 540. The host 940 controls the display controller 540. The host 940 demodulates grayscale data received through an antenna 960 using a modulator-demodulator section 950, and supplies the demodulated grayscale data to the display controller 540. The display controller 540 causes the source driver 520 and the gate driver 530 to display an image on the display panel 512 based on the grayscale data. The source driver 520 has the function of the source line driver circuit 20 shown in FIG. 1 or 2. The gate driver 530 has the function of the gate line driver circuit 30 shown in FIG. 1 or 2.

The host 940 modulates grayscale data generated by the camera module 910 using the modulator-demodulator section 950, and directs transmission of the modulated data to another communication device through the antenna 960.

The host 940 transmits and receives grayscale data, captures an image using the camera module 910, and displays an image on the display panel 512 based on operation information from an operation input section 970.

Although only some embodiments of the invention have been described above in detail, those skilled in the art would readily appreciate that many modifications are possible in the embodiments without materially departing from the novel teachings and advantages of the invention. Accordingly, such modifications are intended to be included within the scope of the invention.

Figure 33:
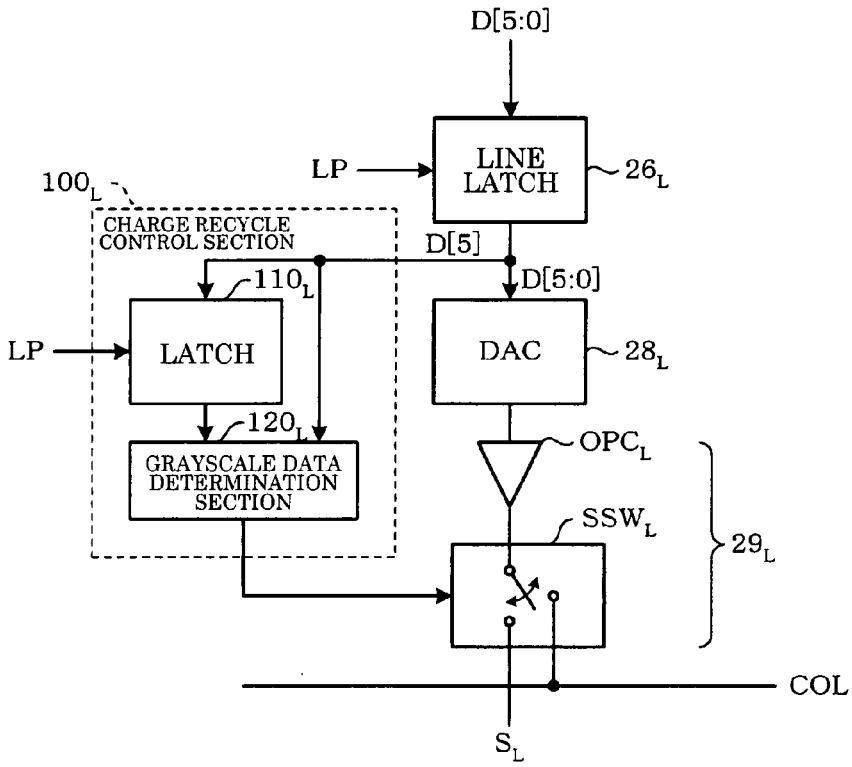
FIG. 33 is a view showing the major portion of the configuration of a source line driver circuit when performing frame inversion drive.
Figure 34:
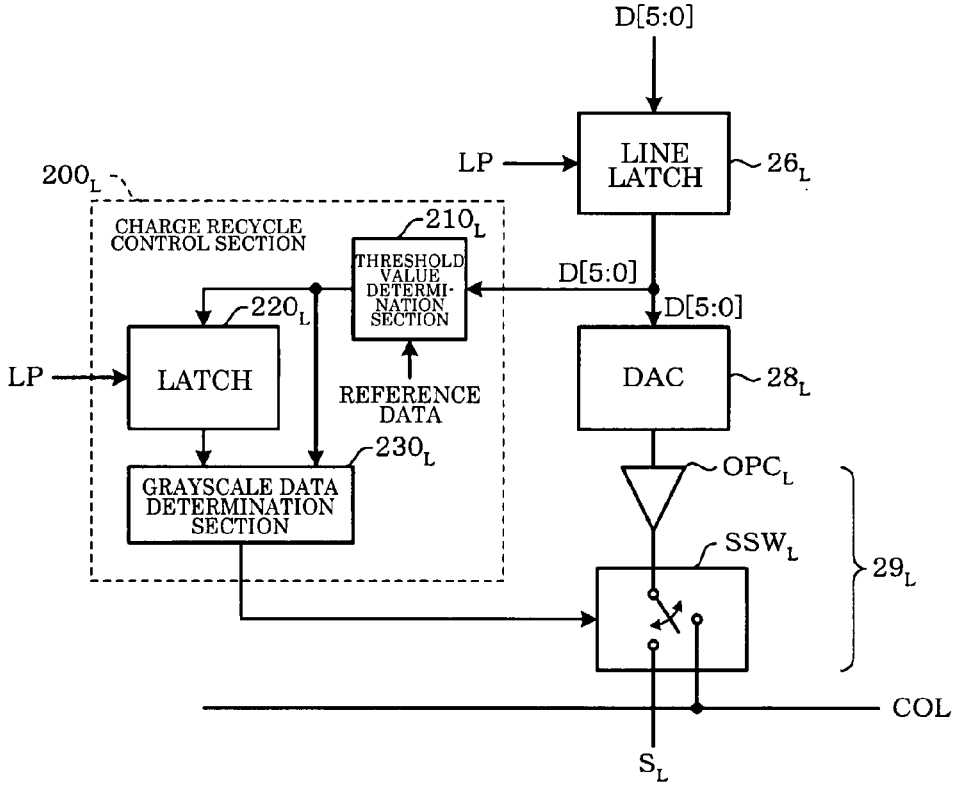
FIG. 34 is a view showing the major portion of the configuration of a source line driver circuit according to a modification when performing frame inversion drive.

For example, the driver circuit may be configured to perform only frame inversion drive without performing line inversion drive. In this case, the switch circuit switch circuits $SWA_L$ and $SWB_L$ of the charge recycle control section $\mathbf{100}_L$ may be omitted in the modification shown in FIG. 13 or 28 to form a configuration shown in FIG. 33 or 34.

The invention may be applied not only to drive the above liquid crystal display panel, but also to drive an electroluminescent display device, a plasma display device, and the like.

Some of the requirements of any claim of the invention may be omitted from a dependent claim which depends from that claim. Some of the requirements of any independent claim of the invention may be allowed to depend from any other independent claim.

What is claimed is:

1. A driver circuit that drives a source line of an electro-optical device based on grayscale data, the driver circuit comprising:

a source line driver section that supplies a grayscale voltage corresponding to the grayscale data to the source line;

a source output switch section that short-circuits the source line and a common line connected with a capacitor before the source line driver section drives the source line;

a charge recycle control section that controls the source output switch section; and a common electrode charge storage switch provided between a first capacitor element connection node connected with one end of a first capacitor element and a common electrode voltage output node to which voltage of the common electrode opposite to the pixel electrode of the electro-optical device through an electro-optical material is supplied, the charge recycle control section determining whether or not to short-circuit the source line and the common line in source output units based on the grayscale data and polarity of a common electrode voltage supplied to a common electrode opposite to a pixel electrode of the electro-optical device, the source output switch section short-circuiting the source line and the common line based on the determination result of the charge recycle control section, and the common electrode voltage output node and the first capacitor element connection node being electrically connected through the common electrode charge storage switch, and the common electrode being then driven by supplying the common electrode voltage to the common electrode voltage output node.

2. The driver circuit as defined in claim 1, when a high-potential-side voltage and a low-potential-side voltage are alternately supplied as the common electrode voltage, the charge recycle control section determining whether or not a grayscale voltage supplied to the source line in a present horizontal scan period is higher in potential than a given reference voltage when the common electrode voltage changes, and the source output switch section short-circuiting the source line and the common line when the charge recycle control section has determined that the grayscale voltage supplied to the source line in the present horizontal scan period is lower in potential than the reference voltage when the common electrode voltage changes from the low-potential-side voltage to the high-potential-side voltage, or determined that the grayscale voltage is higher in potential than the reference voltage when the common electrode voltage changes from the high-potential-side voltage to the low-potential-side voltage.

3. The driver circuit as defined in claim 2, when the charge recycle control section has determined that, based on data of the most significant bit of the grayscale data for generating the grayscale voltage supplied to the source line in the present horizontal scan period, the data of the most significant bit is first data when the common electrode voltage changes from the low-potential-side voltage to the high-potential-side voltage or the data of the most significant bit is second data obtained by reversing the first data when the common electrode voltage changes from the high-potential-side voltage to the low-potential-side voltage, the source output switch section short-circuiting the source line and the common line.

4. The driver circuit as defined in claim 3, the reference voltage being a grayscale voltage corresponding to an intermediate grayscale value.

5. The driver circuit as defined in claim 1, the high-potential-side voltage or the low-potential-side voltage being supplied to the common electrode by line inversion drive.

6. The driver circuit as defined in claim 5, when supplying the high-potential-side voltage or the low-potential-side voltage to the common electrode by frame inversion drive, the charge recycle control section determining whether or not to short-circuit the source line and the common line in source output units based on a first grayscale voltage supplied to the source line in a preceding horizontal scan period and a second grayscale voltage supplied to the source line in the present horizontal scan period, and the source output switch section short-circuiting the source line and the common line based on the determination result of the charge recycle control section.

7. A driver circuit which drives a source line of an electro-optical device based on grayscale data, the driver circuit comprising:

a source line driver section which supplies a grayscale voltage corresponding to the grayscale data to the source line;

a source output switch section which short-circuits the source line and a common line connected with a capacitor before the source line driver section drives the source line; and a charge recycle control section which controls the source output switch section;

the charge recycle control section determining whether or not to short-circuit the source line and the common line in source output units based on a first grayscale voltage supplied to the source line in a preceding horizontal scan period and a second grayscale voltage supplied to the source line in a present horizontal scan period; and the source output switch section short-circuiting the source line and the common line based on the determination result of the charge recycle control section.

8. The driver circuit as defined in claim 7, wherein the charge recycle control section determines whether or not the first and second grayscale voltages are higher or lower in potential than a given reference voltage in source output units; and wherein the source output switch section short-circuits the source line and the common line when the charge recycle control section has determined that the first and second grayscale voltages are higher or lower in potential than the reference voltage.

9. The driver circuit as defined in claim 7, wherein the charge recycle control section compares data of the most significant bit of first grayscale data for generating the first grayscale voltage with data of the most significant bit of second grayscale data for generating the second grayscale voltage, and determines whether or not to short-circuit the source line and the common line based on the comparison result.

10. The driver circuit as defined in claim 9, wherein the reference voltage is a grayscale voltage corresponding to an intermediate grayscale value.

11. The driver circuit as defined in claim 7, wherein the charge recycle control section determines whether or not to short-circuit the source line and the common line based on a first comparison result obtained by comparing first grayscale data for generating the first grayscale voltage with given reference data and a second comparison result obtained by comparing second grayscale data for generating the second grayscale voltage with the reference data.

12. The driver circuit as defined in claim 11, wherein the charge recycle control section determines whether or not both of the first and second grayscale data is higher or lower than the reference data in source output units; and wherein the source output switch section short-circuits the source line and the common line when the charge recycle control section has determined that both of the first and second grayscale data is higher or lower than the reference data.

13. The driver circuit as defined in claim 1, comprising:

a first source short circuit switch provided between the common line and a first source output node to which a voltage output to a first source line of the electro-optical device is supplied; and a source charge storage switch provided between the common line and a second capacitor element connection node connected with one end of a second capacitor element, the first source output node and the second capacitor element connection node being electrically connected through the first source short circuit switch and the source charge storage switch, and the first source line being driven by supplying a voltage corresponding to the grayscale data to the first source output node in a state in which the first source output node and the second capacitor element connection node are electrically disconnected by the first source short circuit switch and the source charge storage switch.

14. The driver circuit as defined in claim 7, comprising:

a first source short circuit switch provided between the common line and a first source output node to which a voltage output to a first source line of the electro-optical device is supplied; and a source charge storage switch provided between the common line and a second capacitor element connection node connected with one end of a second capacitor element;

wherein the first source output node and the second capacitor element connection node are electrically connected through the first source short circuit switch and the source charge storage switch, and the first source line is driven by supplying a voltage corresponding to the grayscale data to the first source output node in a state in which the first source output node and the second capacitor element connection node are electrically disconnected by the first source short circuit switch and the source charge storage switch.

15. The driver circuit as defined in claim 14, comprising:

a common electrode charge storage switch provided between a first capacitor element connection node connected with one end of a first capacitor element and a common electrode voltage output node to which voltage of the common electrode opposite to the pixel electrode of the electro-optical device through an electro-optical material is supplied;

wherein the common electrode voltage output node and the first capacitor element connection node are electrically connected through the common electrode charge storage switch, and the common electrode is then driven by supplying the common electrode voltage to the common electrode voltage output node.

16. An electro-optical device comprising:

source lines;

gate lines;

pixel electrodes, each of the pixel electrodes being specified by the gate line and the source line;

a common electrode opposite to the pixel electrodes; and the driver circuit as defined in claim 1 that drives the source lines.

17. An electro-optical device comprising:

source lines;

gate lines;

pixel electrodes, each of the pixel electrodes being specified by the gate line and the source line;

a common electrode opposite to the pixel electrodes; and the driver circuit as defined in claim 7 which drives the source lines.

18. An electro-optical device comprising the driver circuit as defined in claim 1.

19. An electro-optical device comprising the driver circuit as defined in claim 7.

20. An electronic instrument comprising the driver circuit as defined in claim 1.

21. An electronic instrument comprising the driver circuit as defined in claim 7.

22. An electronic instrument comprising the electro-optical device as defined in claim 16.

23. An electronic instrument comprising the electro-optical device as defined in claim 17.

* * * * *